US005617711A

United States Patent [19]

Rodriguez et al.

[11] Patent Number: 5,617,711

[45] Date of Patent: Apr. 8, 1997

[54] METHOD OF PRODUCING A CONTAINER OF BANANAS AND METHOD OF TRANSFERRING BANANAS

[75] Inventors: Francisco Rodriguez; Elmer Howell; Franklin Sanabria; Raul Fernandez, all of San Jose, Costa Rica

[73] Assignee: Chiquita Brands, Inc., Cincinnati, Ohio

[21] Appl. No.: 534,498

[22] Filed: Sep. 27, 1995

[51] Int. Cl.[6] ..... B65B 25/04

[52] U.S. Cl. ..... 53/475; 53/390; 53/449; 53/474

[58] Field of Search ..... 53/475, 474, 473, 53/472, 449, 445, 446, 447, 444, 390, 157, 143, 142, 175

[56] References Cited

U.S. PATENT DOCUMENTS

| | | | |
|---|---|---|---|
| 1,653,116 | 12/1927 | Parks . | |
| 1,664,308 | 3/1928 | Miller . | |
| 3,097,781 | 7/1963 | Masi | 229/23 |
| 3,393,858 | 7/1968 | Heel . | |
| 3,470,674 | 10/1969 | Madonia | 53/157 |
| 3,738,568 | 6/1973 | Ruda | 229/62 |
| 3,782,619 | 1/1974 | Dittbenner . | |
| 3,959,951 | 6/1976 | Paules | 53/157 |
| 4,056,223 | 11/1977 | Williams | 229/32 |
| 4,081,124 | 3/1978 | Hall | 220/441 X |
| 4,235,065 | 11/1980 | Freeman | 53/475 X |
| 4,435,941 | 3/1984 | Booth et al. | 53/475 |
| 4,572,422 | 2/1986 | Heuberger et al. | 220/462 X |
| 4,635,814 | 1/1987 | Jones | 220/403 |
| 4,725,329 | 2/1988 | Tani | 156/436 |
| 4,777,054 | 10/1988 | Greenhouse | 426/115 |
| 4,872,420 | 10/1989 | Shepard | 119/1 |
| 4,905,456 | 3/1990 | Olaechea | 53/475 X |
| 5,116,140 | 5/1992 | Hirashirma | 383/206 |
| 5,121,877 | 6/1992 | Bodary et al. | 229/120 |
| 5,130,152 | 7/1992 | Alameda | 426/106 |
| 5,350,110 | 9/1994 | Will | 229/125.15 |
| 5,398,834 | 3/1995 | Umiker | 220/6 |
| 5,403,056 | 4/1995 | Wallace | 53/475 X |
| 5,433,335 | 7/1995 | Raudalus | 220/403 |

FOREIGN PATENT DOCUMENTS

| | | |
|---|---|---|
| 0216763 | 9/1986 | European Pat. Off. . |
| 778310 | 7/1957 | United Kingdom . |
| 2043596 | 10/1980 | United Kingdom . |

OTHER PUBLICATIONS

*Prevention of Postharvest Food Losses: Fruits, Vegetables and Root Crops. A Training Manual.* 1989, United Nations Food and Agricultural Organization, pp. 125–128.

*Primary Examiner*—James F. Coan
*Attorney, Agent, or Firm*—Frost & Jacobs

[57] ABSTRACT

A method of producing a container of banana clusters is provided wherein a flexible inner container is inserted into an outer container prior to placing the banana clusters into the outer container, placing a first row of banana clusters in the inner container atop the interior bottom, placing a second row of banana clusters in the inner container such that a portion of the second row is positioned atop a portion of the first row, providing a tunnel pad having a width at least as great as the length of the sidewalls of the outer container and a length greater than the length of the endwalls of the outer container and positioning a portion of the tunnel pad atop and in contact with a portion of the banana clusters of the first and second rows, and placing a third and fourth row of banana clusters in the inner container atop a portion of and in contact with a portion of the tunnel pad. A method of transferring a load of bananas from the outer container to another outer container is also provided.

17 Claims, 15 Drawing Sheets

METHOD OF PRODUCING A CONTAINER OF BANANAS AND METHOD OF TRANSFERRING BANANAS

BACKGROUND OF INVENTION

1. Field of the Invention

This invention relates to an improved method of producing a container of banana clusters, and a method of transferring bananas. More particularly, the present invention provides a new banana packaging technique which saves on material costs and also permits the transfer of banana loads from one container to another.

2. Description of Related Art

Most products must be shipped from one point to another prior to their sale to consumers, and are usually stored for a period of time at one or both locations. During shipping and storing, however, ventilation, heating, and/or cooling must often be provided to the products for various reasons. Perishable products such as fruit, for example, may require ventilation and cooling in order to maintain their freshness. Without such ventilation or temperature control means, these products might arrive at their final destination in a spoiled or damaged condition. Thus, it is usually not sufficient to merely package these perishable products in closed containers.

Previous containerization methods for perishable products such as fruits and vegetables have often employed containers having various ventilation means. For example, most fruits are shipped to retailers from the location where they are grown in corrugated boxes having a plurality of ventilation openings. These corrugated boxes not only provide a means for ventilating and controlling the temperature of the fruit, but are also light-weight and relatively inexpensive to manufacture. One drawback of these corrugated containers, however, is that they generally cannot be reused. Thus, any reduction in the amount of materials used in their manufacture is of great value.

Many products such as fruits and vegetables also have ventilation and temperature parameters which must be varied during shipping and storing. Thus, at certain points during the shipping and/or storing periods it may be necessary to increase ventilation, or raise or lower the temperature of the products in order to ensure optimal freshness. One product for which this is particularly true is bananas. Bananas are typically packed in the form of banana clusters (or hands) into corrugated containers (i.e., boxes) at the plantation where they are harvested in a very green, unripened state. These cardboard boxes are then placed within large shipping containers, which are in turn placed in refrigerated ships. During shipment the pulp temperature of the bananas is kept at a temperature between 56° and 59° F. Once the ship has docked, the bananas are transferred to refrigerated trucks or rail cars, and transported to a warehouse or the like. Once again, the pulp temperature is maintained between 56° and 59° F. in order to retard the ripening of the bananas, thereby prolonging the shelf life of the bananas. In order to maintain this temperature range, it is necessary to provide ventilation means within the cardboard or corrugated boxes. This is typically achieved by providing a plurality of ventilation openings about the surfaces of the boxes. In this fashion cooled air can be circulated within the boxes, thereby maintaining the proper pulp temperature.

Once the bananas have reached the warehouse, the boxes are placed in ripening rooms where the pulp temperature is permitted to rise to about 60° to 62° F. Ethylene gas is also circulated about and within the containers by means of the ventilation openings. The combination of increased temperature and ethylene gas will hasten the ripening process, thereby reducing the time necessary for the bananas to fully ripen. Once this process has been completed, however, it is desirable to remove ethylene gas and decrease the temperature of the bananas in order to decelerate ripening. Since the ripening process within the bananas themselves releases ethylene gas, and since the ripening process will continue even at temperatures below 60° F., it is critical that sufficient ventilation be provided in order to reduce the pulp temperature and remove ethylene. Thus, once the bananas are removed from the ripening rooms and transported to the retailer, it is usually necessary to take steps to ensure that increased ventilation can be provided to the bananas. If the ethylene gas is not removed from the bananas or the temperature is not sufficiently decreased, the bananas will continue to ripen at an accelerated rate, thereby shortening their shelf life. Thus, the containers and packaging employed for bananas must be able to account for the varying ventilation and temperature control needs during the shipping and storing steps.

Other products, including other fruits and vegetables, require similar handling, and may have varying needs during the shipping and storing processes. Thus, there is a need for a container system for products, as well as a method for packing, shipping and storing these products, that will ensure proper shipping and storing conditions. While many of the containers and methods employed in the past have met the needs of producers and retailers, these containers and methods usually required a considerable amount of handling. Additionally, there is always a need for containers and packing methods which improve the shelf life, appearance, and freshness of perishable products such as fruits and vegetables.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Reference will now be made in detail to the presently preferred embodiment of the invention, examples of which are illustrated in the accompanying drawings, wherein like numerals indicate the same elements throughout the views.

Figure 2:
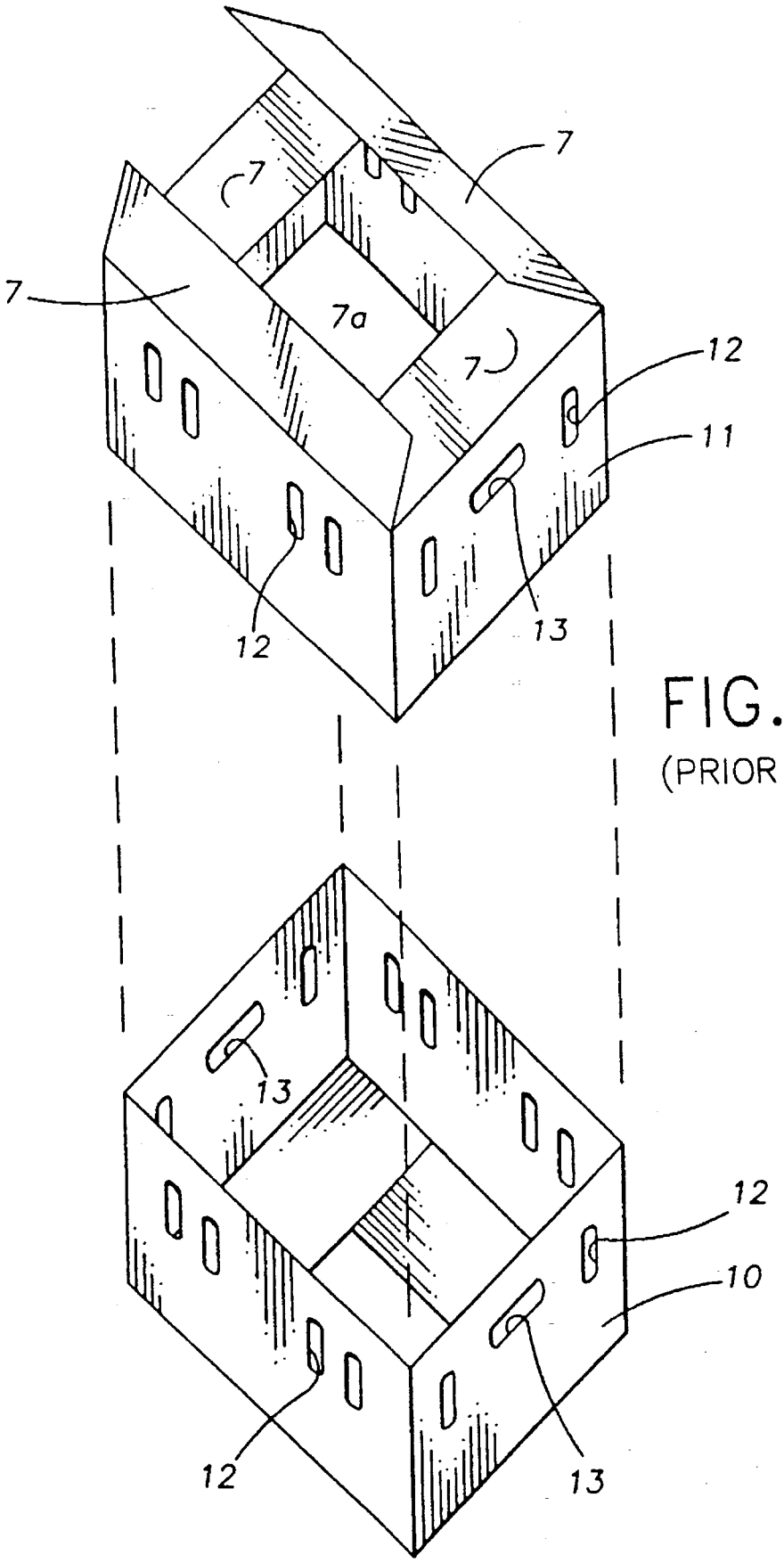
FIG. 2 (PRIOR ART)
FIG. 2 is a perspective view of a prior art container used for shipping products such as fresh fruit and vegetables.

FIG. 2 depicts a prior art container commonly employed for shipping fresh fruits and vegetables such as bananas. The container of FIG. 2 generally comprises a base portion 10 and a top portion 11, and is commonly referred to as a full-telescoping, half-slotted container (HSC). Top portion 11 and base portion 10 are of approximately equal depth, and top portion 11 telescopically slides over base portion 10 to complete the container. Alignable ventilation apertures 12 are provided on the periphery of both portions of the container, as well as alignable hand slots 13 for grasping the container. Hand slots 13 also provide ventilation to the interior of the container. The top and bottom portions each have flaps which are folded over and glued to one another in order to close each portion. When these flaps are folded over, however, a central ventilation opening will be provided in both top portion 11 and bottom portion 10. Top portion 11, for example, has top flaps 7 which are folded over in the manner shown to define central ventilation opening 7*a* through which the product within the container will be visible.

Figure 10:
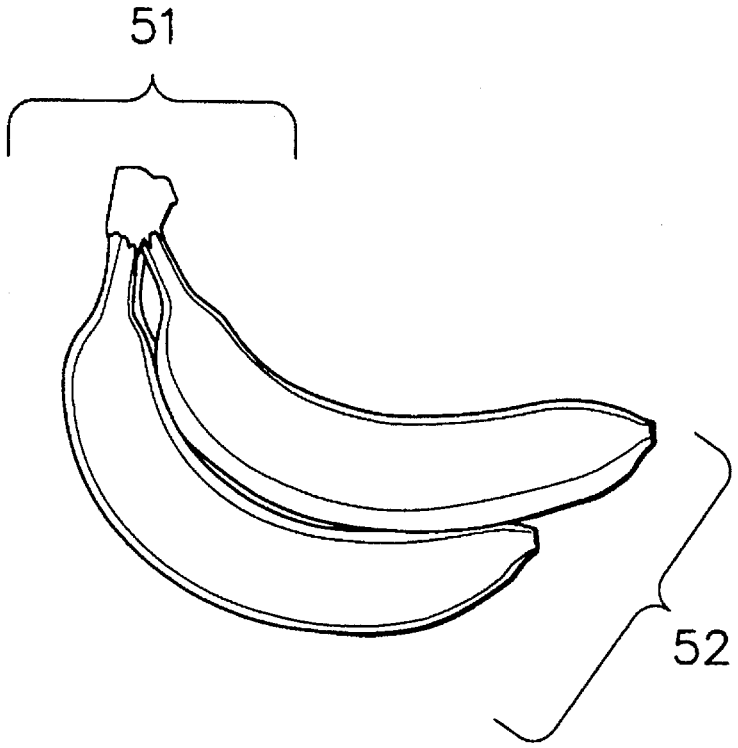
FIG. 10 is a side view of a banana cluster.

When perishable products such as bananas are shipped in the container of FIG. 2, a plastic inner wrap usually must be employed in order to protect the bananas. This inner wrap is typically a tube made of thin plastic, and has a series of ventilation slits provided about the entire surface of the tube. The plastic tube is typically placed in base portion 10, and the open edges of the tube are draped over the sidewalls of base portion 10. In this fashion, the bananas can then be layered within the tube which is contained in base portion 10. Once the bananas have been loaded into the plastic tube and base portion 10, the edges of the tube are merely draped atop the bananas in a loose fashion. Plastic inner tube 50 is shown in FIG. 10. In this manner, ventilation can be provided to the bananas through the ventilation slits, including the necessary circulation of ethylene gas to initiate the ripening process.

One drawback of the container of FIG. 2 when it is employed with the plastic tube referred to above, is that once the bananas arrive at the retail establishment, it is difficult to provide the necessary cooling and ventilation needed to retard the ripening process. The bananas will produce a considerable amount of heat and ethylene while they are ripening. If the bananas are not cooled back to a temperature of approximately 58° F., and if the ethylene gas is not permitted to escape from the container, the bananas will continue to ripen at an accelerated rate thereby reducing their shelf life.

In order to remove the excess heat and ethylene produced by the ripening bananas, the retailer must remove top portion 11, and open the inner plastic tube in order to expose the bananas. In this fashion, the heat and ethylene will be permitted to escape. Obviously, however, this necessitates removing the containers from their ordered arrangement on the pallets. The retailer must then restack the containers of bananas atop one another, usually in a staggered fashion, so that the necessary ventilation will be provided to the bananas. In fact, the retailer must often stack the containers in a less compact arrangement than was present when the containers were on the pallets, so that sufficient amounts of cooled air can be circulated about the bananas.

Figure 3:
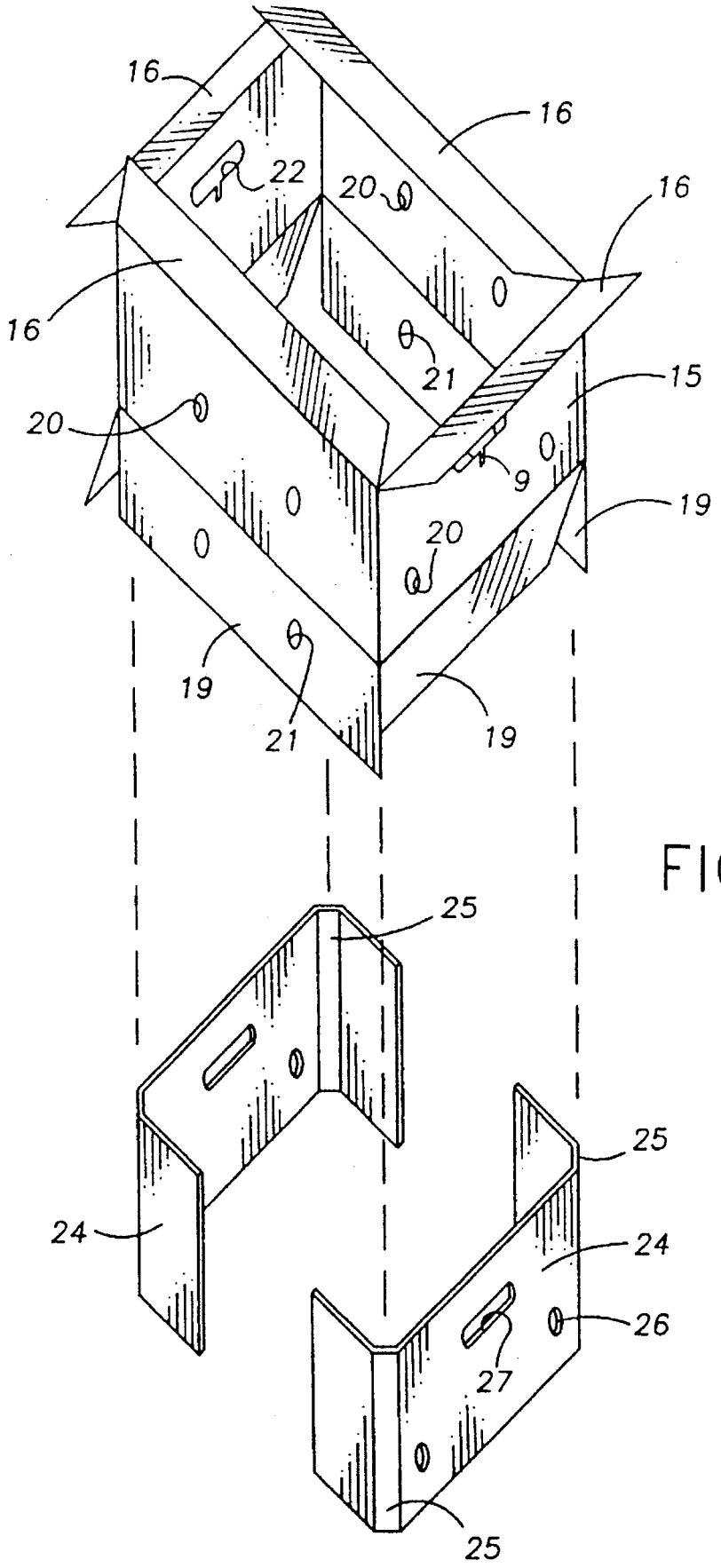
FIG. 3 is a perspective view of the outer container of one embodiment of the present invention.

FIG. 3 depicts an improved container design which offers numerous advantages over that shown by FIG. 2. Container 15 of FIG. 3 is similar in construction to base portion 10 of the prior art design shown in FIG. 2. Like any common rectangular container (i.e., a box), rectangular container 15 comprises four vertical sidewalls and attached bottom flaps 19. Bottom flaps 19 are folded over and glued in the conventional manner to thereby form the container. The width of bottom flaps 19 are such that the bottom of container formed by flaps 19 will not be a continuous surface. In other words, as is the usual case with containers wherein ventilation is important, a central opening will be provided in the bottom of container 15 when flaps 19 are folded over and sealed to one another in a conventional fashion (such as by gluing).

Container 15 also has a plurality of ventilation apertures 20 provided in its sidewalls, as well as ventilation apertures 21 provided in bottom flaps 19. Any number of ventilation apertures may be provided depending upon the product being shipped as well as considerations of container strength. As was the case in the container of FIG. 2, hand slots 22 are provided in the sidewalls of container 15, and the slots serve the dual purpose of providing added ventilation as well as a means for grasping the container.

Figure 5:
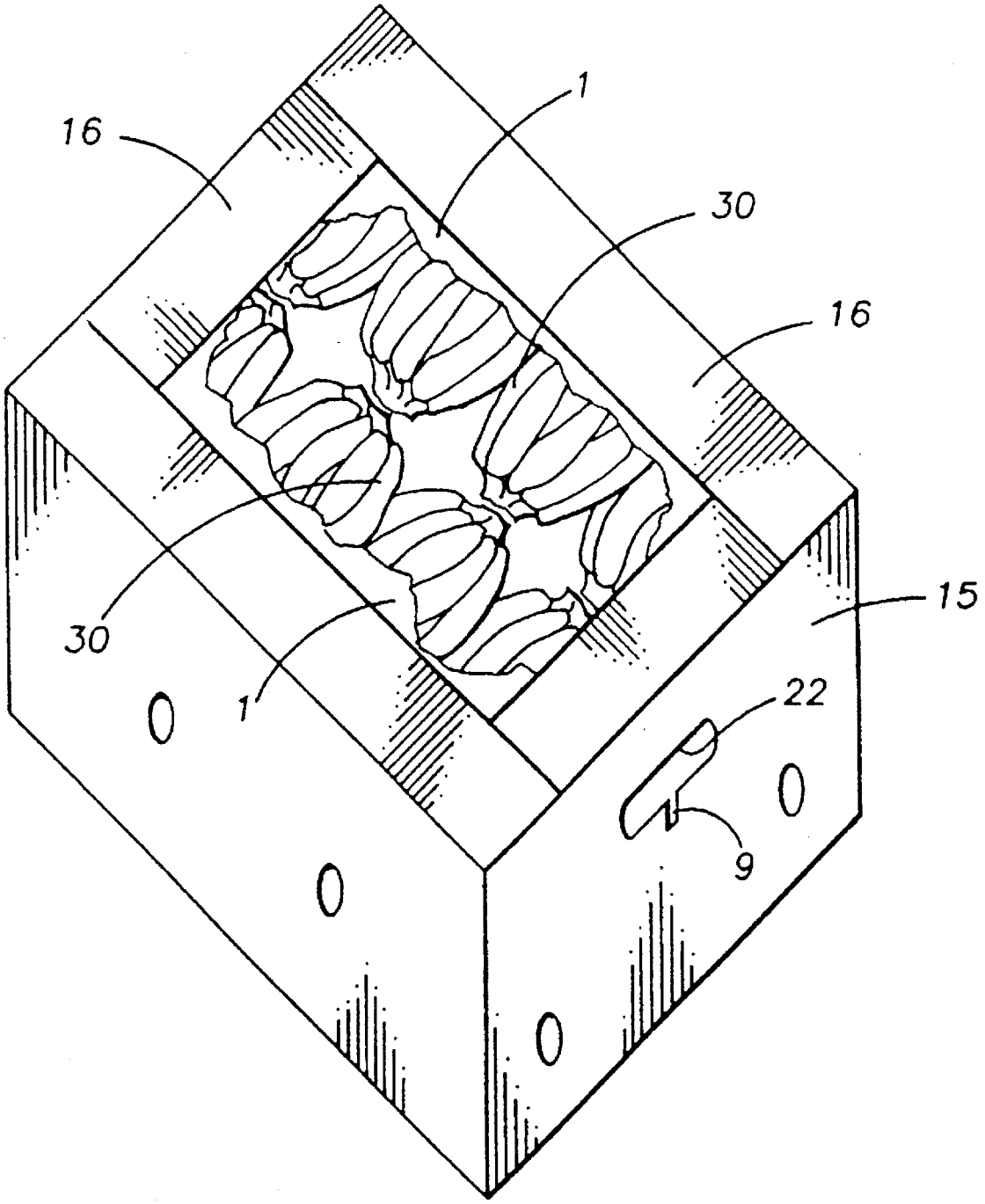
FIG. 5 is a perspective view of the container system of one embodiment of the present invention, after the inner bag has been opened.

Instead of a separate telescoping top portion as was the case in the container of FIG. 2, container 15 of FIG. 3 has integral top flaps 16. Once the products to be shipped are loaded within container 15, top flaps 16 are folded over in the conventional fashion and glued, much the same way that top flaps 7 on top portion 11 on the container of FIG. 2 would be. Top flaps 16 are preferably of a slightly shorter width, however, than top flaps 7 in FIG. 2. This provides a larger central ventilation opening, and therefore increased ventilation for the product. The central ventilation opening is shown by FIG. 5 as the area in the top of assembled container 15 through which the bananas 30 are visible. It has been found that an integral lid provides sufficient rigidity and strength, particularly when the insert to be described is employed.

The container of FIG. 3 also results in significant cost savings, since less material will be employed for the construction of the container (as compared to that of FIG. 2).

Shipping containers such as those of FIGS. 2 and 3, are often made of corrugated board, and are generally disposed of after a single use. Thus, employing the container design of FIG. 2, even when the insert described below is employed, results in a significant reduction in the amount of disposed material.

In many instances, it may be necessary to reinforce container 15. Thus, as further shown in FIG. 3, support inserts 24 are preferably utilized. Inserts 24 fit within container 15 against the sidewalls and endwalls of the container. Obliquely angled corner portions 25 on support inserts 24 provide added support, as a stronger triangular structure will be situated in each corner of container 15 when inserts 24 are utilized. Optionally, a single support insert which fits against the entire interior sidewalls and endwalls may be employed, and the corner portions may optionally be of a right-angle configuration. When ventilation apertures 20 are provided in the sidewalls of container 15, corresponding alignable ventilation apertures 26 can be provided in inserts 24 so that unimpeded fluid communication to the interior of the container will be maintained. In addition, alignable hand slots 27 are also provided in support inserts 24 and ensure that hand slots 22 on container 15 can serve their intended dual purpose as previously described.

As stated previously, many products such as fruits and vegetables have varying ventilation and temperature requirements, and the prior art methods have been unable to effectively deal with these requirements. The plastic inner wrap or tubes utilized in the shipment of bananas, for example, require manual unstacking and restacking by the retailer, and do not provide the most protective environment for the bananas during shipment. In order to alleviate these problems, a novel inner container (i.e., plastic bag) has been developed. While this inner container is preferably employed with the improved container design of FIG. 3, it can be effectively used with numerous other container or box designs, including that of FIG. 2.

Figure 1:
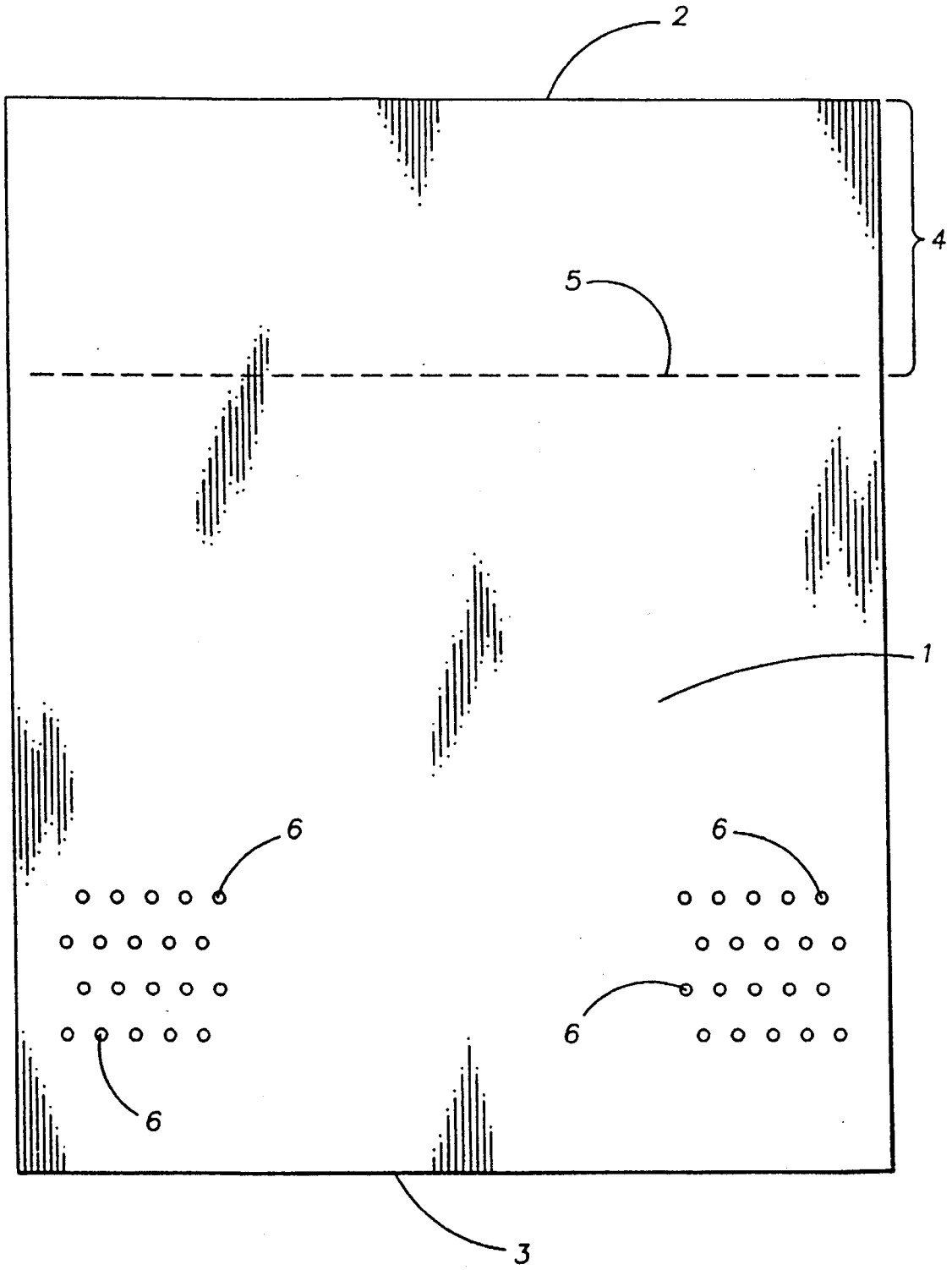
FIG. 1 is a side plan view of the inner bag of one embodiment of the present invention.
Figure 4:
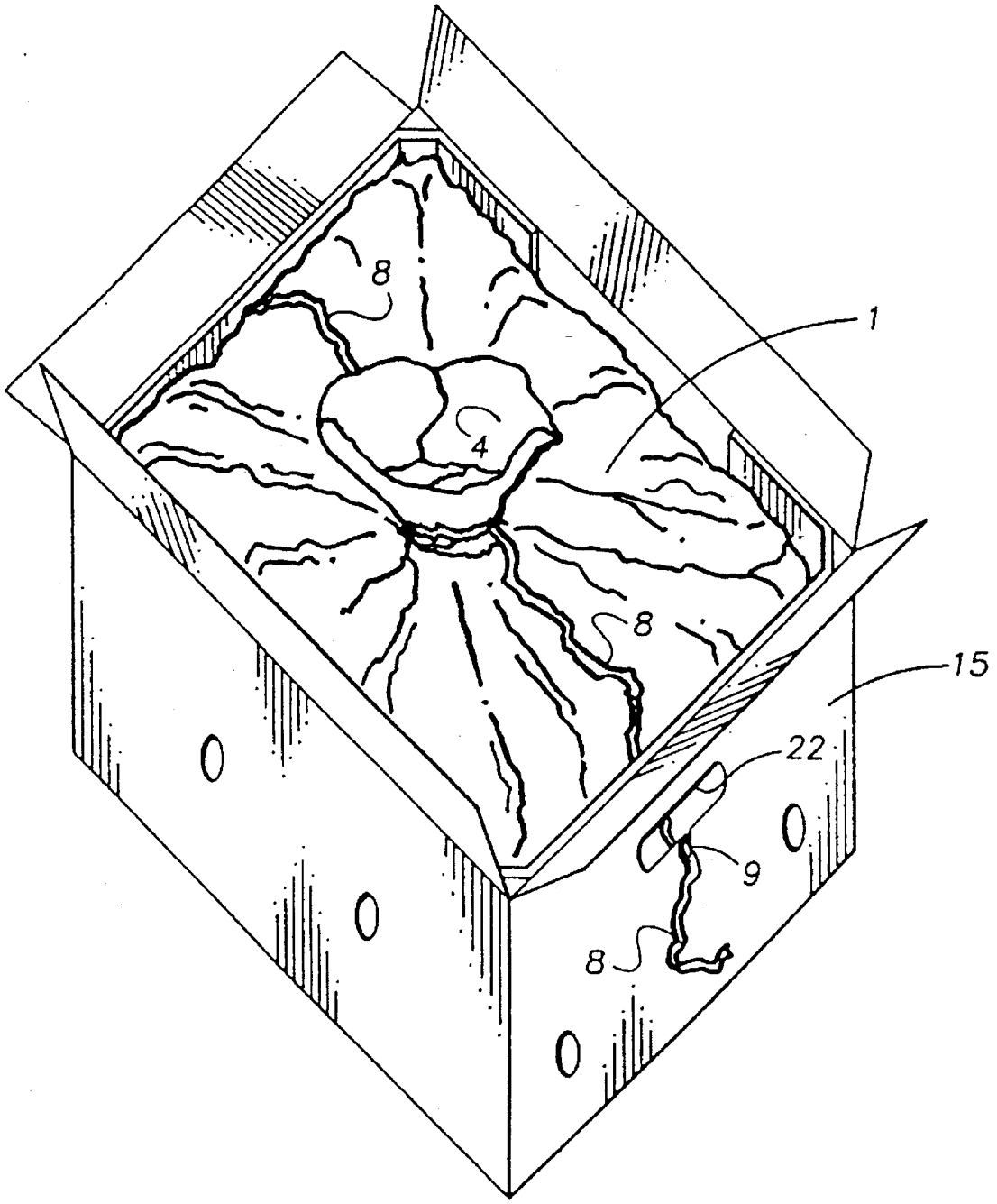
FIG. 4 is a perspective view of the container system of one embodiment of the present invention, wherein the outer container has not yet been closed.

As shown in FIG. 1, the inner container preferably comprises a flexible bag 1 having an open end 2 and a sealed bottom end 3, and is identical in this respect to a typical household trash bag. Bag 1 can be constructed of any of a number of materials, and is preferably made of substantially clear, flexible plastic such as that typically used for plastic bags, however bag 1 could also be manufactured of opaque material. It should be noted that bag 1 is depicted in FIGS. 4 and 5 as opaque merely for clarity. The presently preferred material for bag 1 is linear low density polyethylene, having small amounts of additional additives to ensure that bag 1 may be easily opened and be of adequate strength, while maintaining its inexpensiveness. The exact formula for the material of bag 1 is not critical, and various combinations of materials well known to those skilled in the art can be readily employed.

Bag 1 differs from other plastic bags in that bag 1 also has a perforation 5 located adjacent top portion 4 of bag 1. Top portion 4 is defined as the area between open end 2 and perforation 5. As shown by FIG. 1, perforation 5 extends substantially across the entire width of bag 1, but not entirely. This ensures that when bag 1 is opened, for example, by sweeping the bag through the air to allow air to enter open end 2, such opening of the bag will not cause the bag to tear at perforation 5. In addition, a plurality of bags are usually manufactured on a roll, with individual bags separated by larger perforations between bags. Thus, perforation 5 only extends partially across the width of bag 1 so that when individual bags are removed from the role, the roll will tear between bags, rather than an individual bag tearing at perforation 5. As will be understood, perforation 5 can be replaced by any type of area of weakness. For example, bag 1 could be scored at the location where perforation 5 is now positioned. Alternatively, bag 1 could even be molded so that the area of weakness corresponds to a thin area in bag 1. Thus, perforation 5 can be replaced by any suitable area of weakness.

Bag 1 also has a plurality of ventilation apertures 6 located adjacent bottom end 3 at each corner of the bag. It should be noted that bag 1 is actually tubular in nature, and FIG. 1 depicts bag 1 in a flat form. Ventilation apertures 6 are preferably arranged in a series of rows, with the apertures in adjacent rows offset from one another in order to strengthen bag 1. If ventilation apertures 6 are not offset, the bag will be more likely to tear at the apertures. Preferably, bag 1 has twenty ventilation apertures 6 located adjacent each of the lower corners of the bag, or a total of eighty such apertures. The preferred positioning of ventilation apertures 6, as shown in FIG. 1, will help ensure that the apertures align properly with the various apertures on container 15 of FIG. 3.

Bag 1 of FIG. 1 is designed to be used with an outer container generally comprising a box typically made of cardboard, such as those of FIGS. 2 and 3, and preferably that of FIG. 3. In order to employ flexible bag 1, the container of FIG. 3 is first constructed by sealing bottom flaps 19 in their closed position, and preferably placing support inserts 24 within container 15. Bag 1 is then opened in the typical manner in which one would open a plastic bag (i.e., by forcing air into open end 2). Bag 1 is then inserted into container 15 with open end 2 of bag 1 extending out the top of container 15. Open end 2 is then draped about the outside of the sidewalls of container 15, thereby completely exposing the interior of bag 1 which is in place in container 15. The products to be packaged are placed within bag 1 which is positioned within container 15. When the product being loaded is a fresh fruit such as bananas (in the form of banana clusters as shown in FIG. 5), the product is often loaded within bag 1 and container 15 in an orderly fashion. For example, it is preferred that bananas be loaded into bag 1 in four layers or rows (as will be discussed in more detail later). The new packing method described later will ensure that the bananas will not extend above the sidewalls of container 15, and thus ensures that top flaps 16 can be sealed in the manner described previously.

Once the product has been loaded within bag 1, which is in place in container 15, top portion 4 of bag 1 is cinched together by hand in the manner one typically employs for plastic bags, such as a consumer might do with a plastic garbage bag. After top portion 4 of bag 1 has been cinched together by hand, there is a need to secure the cinched top portion in order to seal the bag closed. This is accomplished by providing cord 8. Cord 8 is preferably manufactured of polypropylene twine, however it can be manufactured of any of a number of materials including various fibers, and polypropylene twine is merely preferred for its strength and cost. Cord 8 is securely tied about cinched top portion 4 using any type of knot which will not become loosened when cord 8 is pulled. Thus, a simple square knot can be employed to securely cinch top portion 4 of bag 1 with cord 8. It is preferred that cord 8 be knotted about top portion 4 (i.e., between open end 2 and perforation 5) somewhere near the middle of the length of cord 8, and that cord 8 be of sufficient length so that each end of cord 8 may extend through each hand slot 22 of container 15 as shown by FIG. 4. In other words, when cord 8 is knotted about top portion 4 of bag 1, thereby sealing bag 1 shut, each end of cord 8 should extend through hand slots 22 located on opposite sidewalls of container 15.

It is also preferred that a small slit 9 be provided in the bottom of each hand slot 22 (as shown by FIG. 3), and a corresponding slit may also be provided on hand slot 27 of each insert 24 in the same location. When the ends of cord 8 extend out hand slots 22, a portion of cord 8 may be inserted within slit 9 (and the corresponding slits on inserts 24) in order to anchor cord 8 to container 15. This will ensure that the ends of cord 8 will remain outside of container 15 during transit. After cord 8 has been positioned in this fashion, top flaps 16 of container 15 may be folded over and secured in the manner described previously, thereby containerizing the product. Alternatively, cord 8 may be secured to top flaps 16 by an suitable means, such as a slit contained therein. For example, the process of producing the container 15 may result in the formation of hand slots in top flaps 16. Since these hand slots are not utilized in top flap 16, they may be only partially formed, and thus cord 9 can be secured within these partially-formed hand slots. The containerized product may then be stacked upon pallets in various commonly used patterns for shipping and/or storage. An additional feature of this system is that since cord 8 extends out of each hands slot 22, cord 8 will generally be accessible even when a plurality of the containers are tightly positioned on a pallet, since most stacking patterns commonly employed will ensure that at least one hand slot 22 of each container 15 is located somewhere about the periphery of the pallet load readily accessible without requiring one to remove the containers from the pallet.

As an additional alternative, top portion 4 of bag 1 may be folded over in order to substantially seal bag 1 at top portion 4, and portions of closed bag 1 may then be positioned either adjacent to, or extending out from hand slots 22. In this fashion, bag 1 can be severed at perforation 5 merely by jerking the portion of bag 1 which is positioned near, or extends out from, hand slots 22.

As described previously, many products such as bananas require ventilation and/or temperature control in order to ensure that the goods arrive at their destination in a marketable condition. Many of these products also require varying amounts of ventilation during shipping. When goods such as bananas have been packaged in the fashion described above within sealed bag 1 placed within container 15, ventilation can still be provided to the bananas through ventilation apertures 6 on bag 1. When the preferred pattern for ventilation apertures 6 as shown by FIG. 1 is employed, at least a portion of ventilation apertures 6 will be substantially in vertical alignment with one or more ventilation apertures 20 and 21 on container 15. This permits cooling or heating air to be circulated amongst the bananas when necessary, and also will allow the ethylene gas used for ripening to enter bag 1 containing the bananas. Because the top portion of bag 1 is sealed, however, a "micro-climate" is created within bag 1. While ventilation apertures 6 in bag 1 permit air and ethylene to be circulated about the bananas, the sealed nature of bag 1 at top portion 4 significantly limits the amount of moisture which is lost to the environment.

The ability of the above container system and packaging method to reduce the amount of moisture lost from the inner container is significant for the shipment of products such as bananas, as significant moisture losses usually take place when conventional packaging systems are employed. For example, bananas are typically packaged in 40 pound boxes. The 40 pound weight, however, refers to the weight of the bananas at the time of delivery to the retailer. Due to moisture losses during shipping, approximately 41.5 to 42.0 pounds of bananas must be packaged into each box prior to shipping. Since such a load of bananas conventionally packaged will lose up to two pounds of moisture, each box of bananas will arrive at the retailer weighing approximately 40 pounds, as required. When the above packaging system and methods are employed, however, moisture losses are reduced by approximately 0.5 pounds per box. Thus, the weight of the bananas packaged into the container system prior to shipping can be approximately 0.5 pounds less, as compared to conventional packaging systems. Additionally, since the number of full banana boxes which may be placed into the large shipping receptacles is limited by total weight, more loaded boxes of bananas can be placed within each receptacle, since each box of bananas will weigh approximately 0.5 pounds less. For the typical large shipping receptacle employed for bananas, this packaging system and method results in the ability to load approximately 28 more banana boxes into each shipping receptacle.

As also mentioned previously, once the boxes arrive at the retailer, or even at some other point in time, it may be necessary to significantly increase the amount of ventilation that can be provided to the product. This is particularly true for bananas, since, as mentioned previously, the retailer usually must increase the ventilation in order to slow the ripening process. At this point, cord 8 comes into play. When the retailer receives a shipment of loaded banana boxes, for example, the retailer merely firmly pulls cord 8 and top portion 4 of bag 1 is completely severed from the remainder of the bag due to perforation 5. Top portion 4 can then be readily pulled through hand slot 22, thereby completely removing top portion 4 of bag 1 from the box of bananas or other products. As shown by FIG. 5, this will completely expose the interior of bag 1 (in this case the load of bananas 30) through the central opening provided in the top of container 15. The remaining portion of bag 1 is also visible in FIG. 5 through the central opening. Thus, there is no longer a need for the retailer to open the boxes to provide further ventilation to the bananas. In fact, if sufficient ventilation can be provided to the boxes while they are on the pallet, there will no longer be a need for the retailer to unstack the banana boxes to increase the ventilation due to the increased size of the central ventilation opening in the top of container 15, thereby greatly reducing the amount of space needed for storage of the bananas and the labor required of the retailer. Additionally, since cord 8 is accessible without a need for the retailer to access the interior of container 15 (e.g., either by opening the container or reaching through the central opening of the container top), there is no need for the retailer to remove boxes from the pallet in order to open the inner container. Thus, the inner container may be opened even when a plurality of boxes are stacked atop one another.

Testing of this packaging system and method has also demonstrated that the reduction in moisture loss and the ability of the retailer to provide increased ventilation to the bananas will result in a marked improvement in the quality and appearance of the bananas. When bananas shipped in the conventional manner are placed side-by-side with those shipped using this container system, the improvements in product quality are readily apparent even to the unexperienced observer. The bananas have an overall freshest appearance and there is considerably less brown spotting on the bananas. This will, of course, result in greater consumer acceptance of the bananas.

Figure 6:
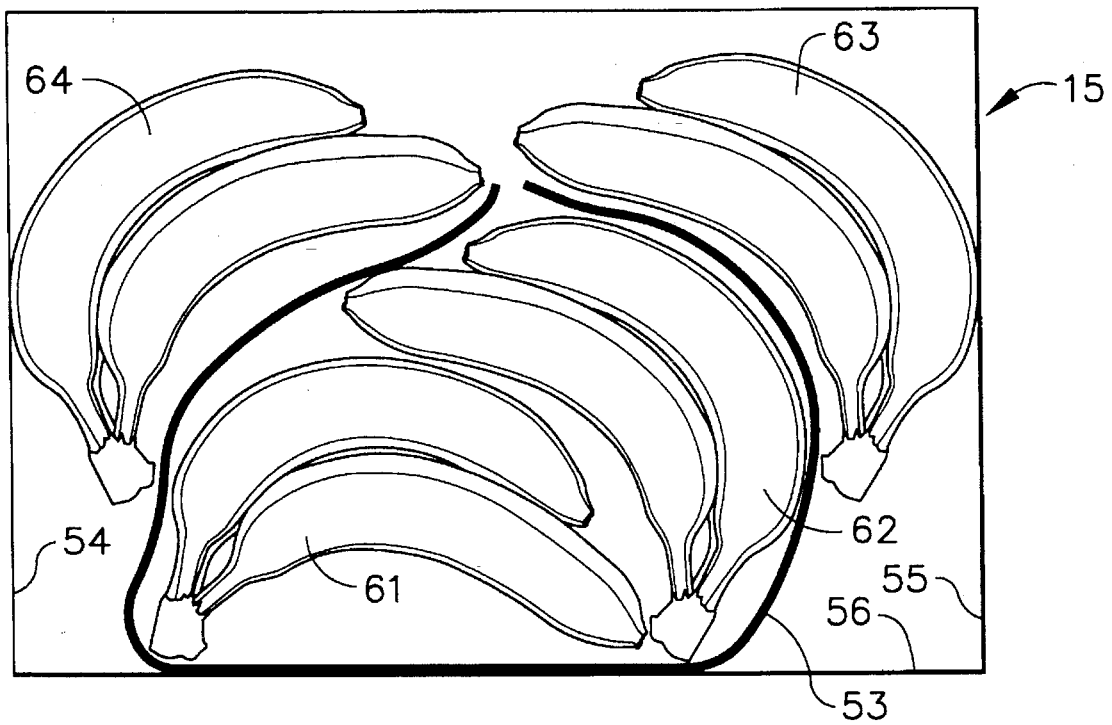
FIG. 6 (PRIOR ART)
FIG. 6 is a cut-away view of a prior an packing configuration for banana clusters.

An alternative method of packing the bananas into the outer container has also recently been introduced(i.e., a method of producing a container of banana clusters). As mentioned previously, for many years bananas have been packaged in rectangular outer containers (boxes) in a four-layer (i.e., row) pattern. This traditional packing method is shown in FIG. 6. In fact, the boxes generally utilized for shipping bananas are all of identical dimensions, and are sized to provide just enough space for the four-row packing pattern of FIG. 6 wherein each row generally comprises 3–4 banana clusters each. The bananas of each row are positioned substantially perpendicular to the sidewalls of the box, and parallel to the endwalls of the box. As mentioned previously, an inner plastic tube is also typically employed, however the tube has been omitted from FIG. 6 for clarity.

Figure 9:
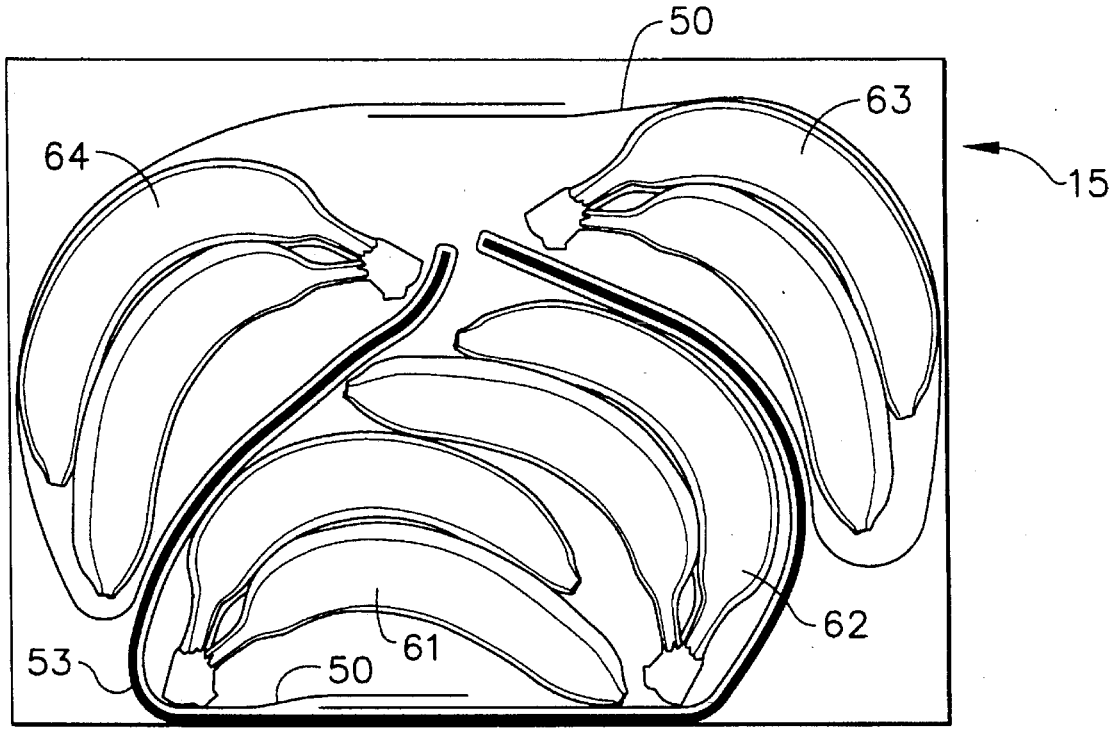
FIG. 9 (PRIOR ART)
FIG. 9 is a cut-away view of another packing method of the prior art.

The packing method of FIG. 6 is readily accomplished in the following manner. It should first be noted that each banana cluster can be defined as having a crown portion 51 and a tip portion 52, as shown in FIG. 10. When employed, inner tube 50 is inserted into box 15, in the manner previously described. The use of inner tube 50 is depicted in FIG. 9, however it should be pointed out that the packing pattern of FIG. 9 is the crowns-up pattern to be described. An optional tunnel pad 53 may then be inserted into inner tube 50, or directly into box 15 if inner tube 50 is not employed. Tunnel pad 53 can, for example, be a rectangular sheet of Kraft paper, having a width at least as great as the length of first and second sidewalls 54 and 55, respectively. The tunnel pad should also have a length greater than the length of the endwalls 57 and 58 of box 15. Tunnel pad 53 is placed so as to extend between the endwalls of the box across the interior bottom 56 and up side walls 54 and 55 of box 15 (due to its length being greater than the length of the endwalls). First and second rows 61 and 62, respectively, of banana clusters may then be inserted into box 15, within the inner tube when employed, and atop tunnel pad 53. If inner tube 50 is employed, it is preferable that tunnel pad 53 be inserted into box 15 prior to insertion of inner tube 50. In this fashion, the bananas will not directly contact tunnel pad 53, thereby reducing the amount of scarring on the bananas. After insertion of first row 61 and second row 62, the portion of tunnel pad 53 extending up side walls 54 and 55 may then be folded over the first and second rows of bananas, as shown in FIG. 6.

As further shown in FIG. 6, first row 61 is preferably positioned so that the crown portion of the banana clusters of first row 61 are nearer to side wall 54 than to side wall 55. The second row 62 of banana clusters is then inserted so that a portion of these banana clusters are positioned atop a portion of the banana clusters of first row 61, as shown in FIG. 6. The banana clusters will rest in the fashion shown in FIG. 6 due to the natural curvature of the bananas, provided that the clusters of the second row are oriented opposite those of the first row. Thus, as shown by FIG. 6, the crown portion of the banana clusters of second row 62 will lie adjacent the tip portion of the banana clusters of first row 61. This combination of first and second rows 61 and 62 is preferably centered between side walls 54 and 55, and both rows extend between the endwalls of box 15. For the size of box typically employed in the shipment of bananas, each row will typically comprise between about 3 and about 4 banana clusters each, in order to ensure that each row extends from endwall to endwall.

After tunnel pad 53 has been folded over the first and second rows of banana clusters, third row 63 and fourth row 64 of banana clusters are inserted into the box. Once again when inner tube 50 is employed, the bananas of the third and fourth rows are also preferably inserted into inner tube 50, in order to ensure that they do not directly contact tunnel pad 53. Third row 63 of banana clusters is inserted into the container such that the crown portion of each banana cluster of third row 63 will be positioned between second row 62 and second side wall 55. Likewise, fourth row 64 of banana clusters is inserted so that the crown portion of the fourth row will be positioned between first row 61 and first side wall 54.

Unfortunately, however, due to the nature of this packing method, not only will third and fourth rows 63 and 64 not be snugly secured in box 15, they will also generally extend above the top of box 15. In the past this problem has been remedied by employing a box such as that shown in FIG. 2. Since top portion 11 of the box design in FIG. 2 would telescope over base portion 10, this would ensure that the banana clusters of the third and fourth rows would be held within the box. During shipment, the bananas would tend to settle naturally due to vibrations, and top portion 11 of the box would begin to settle downward. Obviously, however, this would cause friction between the banana clusters of the third and fourth rows and the interior surfaces of top portion 11, thereby increasing the amount of bruising and other damage to the bananas. In addition, the crown portion of the banana clusters of third and fourth rows 63 and 64 would tend to rub against the bananas of second row 62 and first row 61, thereby further increasing scarring and bruising. While the tunnel pad would help in alleviating this problem, as well as reducing other friction points between the banana clusters, a rather thick tunnel pad was necessary (typically 61 or 69 Lb./M.S.F. when a Kraft paper tunnel pad was employed). While this would help reduce scarring caused by the crown portions of the third and fourth rows, the thickness of the tunnel pad itself would produce its own scarring on the fruit due to friction. Thus, while the tunnel pad would help reduce some of the damage to the bananas, it is certainly not an ideal solution.

Figure 7:
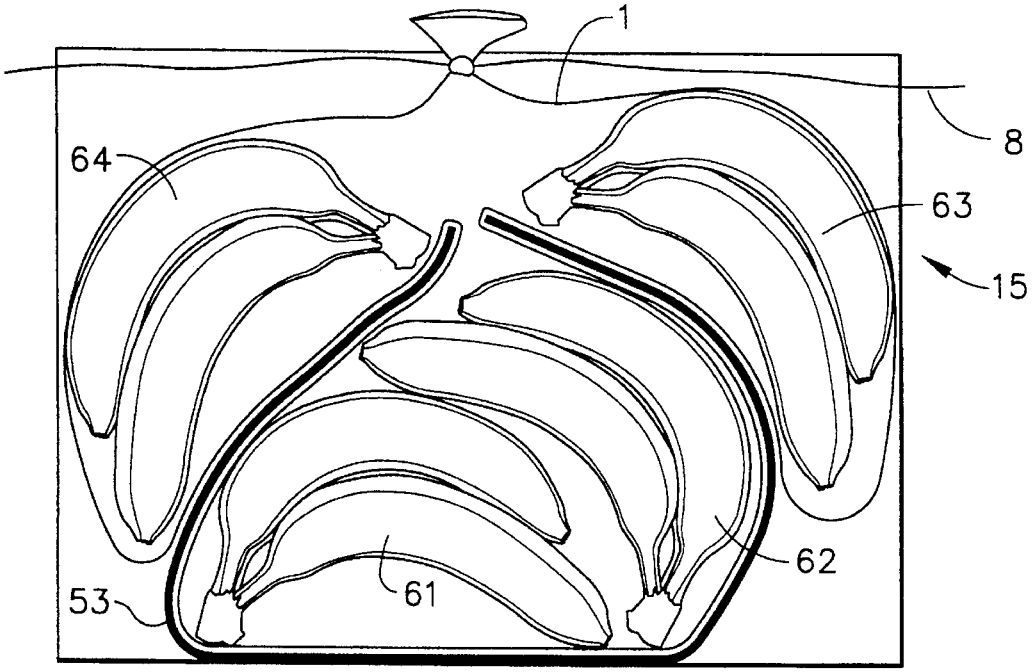
FIG. 7 (PRIOR ART)
FIG. 7 is a cut-away view of the crowns-up packing configuration of the prior art.

In light of the foregoing problems, a new "crowns-up" packing method has been developed. This crowns-up packing method allows one to use not only the prior art box designs of FIG. 2, but also boxes such as that shown in FIG. 5. While the boxes may be of the same exact dimensions of that used in the packing method of FIG. 6, this new packing method, as shown in FIG. 7, ensures a much more compact configuration for the bananas in the box. As shown in FIG. 7, the crowns-up packing method (which is prior art for the present application) essentially comprises placing third row 63 and fourth row 64 of banana clusters in a "crowns-up" configuration. In this manner the tip portion of third row 63 of banana clusters will be positioned between second row 62 of banana clusters and second side wall 55. By pressing the banana clusters of third row 63 downward slightly during packing, the tip portion of third row 63 will be snugly positioned between second row 62 and second sidewall 55. Because of the curvature of bananas near the crown portion, such snug positioning was heretofore not possible when using the "crowns-down" configuration of FIG. 6. Likewise, the tip portion of fourth row 64 of banana clusters is snugly positioned between first row 61 and side wall 54, as shown in FIG. 7. By producing a container of banana clusters in this fashion (i.e., a method of packing bananas), the crown portions of third row 63 and fourth row 64 will no longer rub against second row 62 and first row 61. This, in turn, allows the use of a much thinner, and therefore softer, tunnel pad. For example, the Kraft paper utilized for the tunnel pad will be reduced to one having a strength of 42 Lb./M.S.F. The use of a thinner and therefore softer, tunnel pad provides further benefits in that less friction will be produced, and therefore less scarring of the bananas will occur. This packing method still requires, however, that tunnel pad 53 not contact the bananas directly. In addition, by using this new packing method, the bananas will no longer extend above the top of box 15 after packing, even though an identically-sized box is employed in FIG. 7 as compared to FIG. 6. It should be noted for sake of clarity that the packing method shown in FIG. 6 is the configuration after the bananas have settled, and therefore the bananas in FIG. 6 are not shown extending above the top of box 15, even though this would normally be the case immediately after packing.

Figure 8:
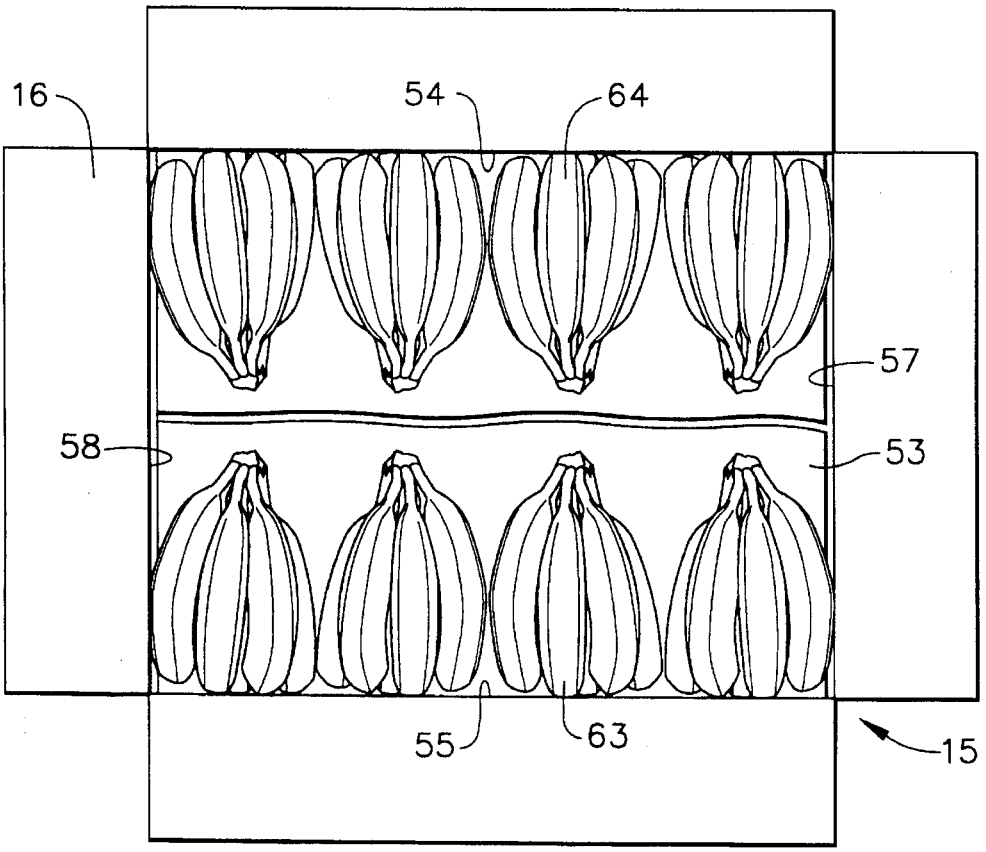
FIG. 8 (PRIOR ART)
FIG. 8 is a top plan view of the packing configuration of FIG. 7.

While the crowns-up packing method can be used in the prior art box design of FIG. 2, it is preferable that the box design of FIG. 3 be employed. In addition, it is also preferably that tunnel pad 53 (as previously described) also be employed in order to offer further protection. In fact, FIG. 8 depicts a top plan view of a container of banana clusters packed in the crowns-up pattern. As will be noted in FIG. 8, the banana clusters of third row 63 and fourth row 64 extend substantially perpendicularly away from side walls 54 and 55, and are positioned substantially parallel to end walls 57 and 58. As also shown in FIG. 8, the bananas are positioned atop tunnel pad 53, and therefore the clusters of first row 61 and first row 62 are not visible in FIG. 8.

While the packing method of FIGS. 7 and 8 may readily be employed using the inner plastic tube described previously, it is preferred that bag 1 (as previously described) be employed in conjunction with this packing method. As also shown in FIG. 7, it is preferable that tunnel pad 53 be disposed within box 15, but not within bag 1. In this manner, bag 1 prevents the banana clusters from directly contacting tunnel pad 53, thereby eliminating the possibility of friction between tunnel pad 53 and the banana clusters. FIG. 9 depicts the crowns-up packing pattern employing inner plastic tube 50.

Methods of the Present Invention

FIG. 1 depicts the method of packing the bananas into the outer container according to the present invention (i.e., a method of producing a container of banana clusters). Once again a standard corrugated box 15 may be employed, however the box of FIG. 3 is preferred. It should also be pointed out that the box of FIG. 3 is preferably modified slightly in that the ventilation apertures in the sidewalls of the container are moved upward slightly in order to prevent the tip portion of the bananas in the upper rows from protruding out of these ventilation apertures. The ventilation apertures on the endwalls of container 15, may remain in the location shown in FIG. 3, since, as will be understood, there is no possibility that any portion of the bananas will protrude from these apertures.

Figure 11:
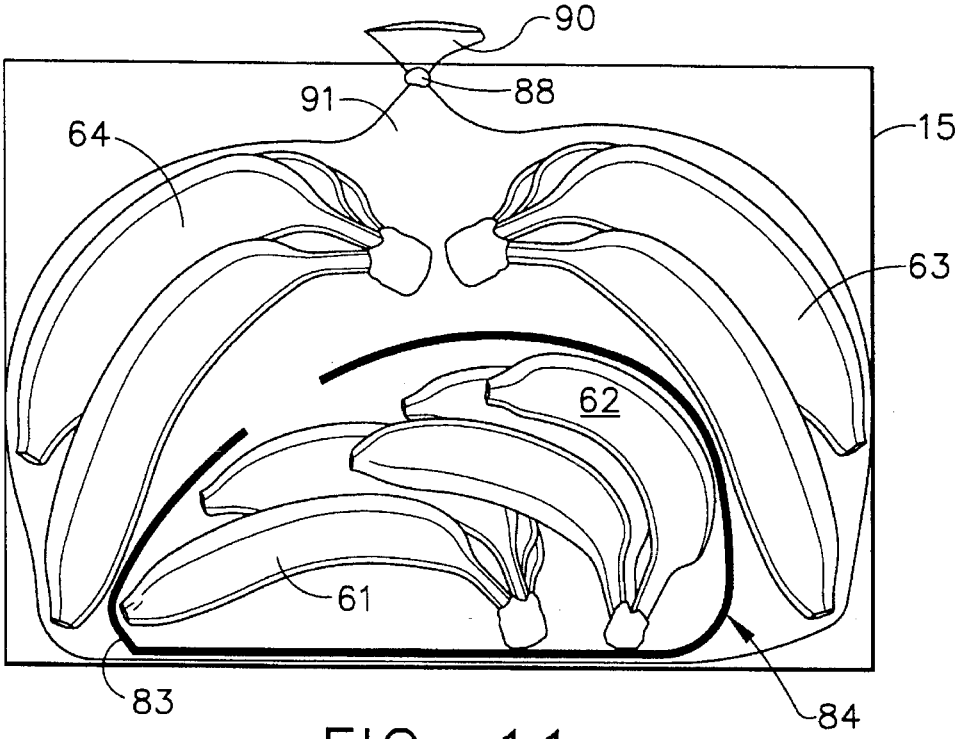
FIG. 11 is a cut-away view of the packing method of the present invention.

As shown in FIG. 11, the new packing method essentially employs a shorter tunnel pad, in conjunction with a reversal of the orientation of first row 61 of bananas. These two modifications, in turn, permit the use of a much smaller inner container 1 (i.e., the bag). In this manner, not only are significant savings in materials achieved, but also other beneficial results to be described later.

In the packaging pattern depicted in FIG. 7, tunnel pad 53 has a length of between 32 and 33 inches, and a width approximately equivalent to the length of the sidewalls outer container 15. When the crowns-up configuration of FIG. 7 is not employed (i.e., FIG. 6), tunnel pad 53 may even be as long as 35 inches. As mentioned previously, tunnel pad 53 is also typically made from sturdy Kraft paper which creates significant amounts of friction if permitted to contact the bananas directly. This friction between the Kraft paper and the bananas will cause noticeable scarring of the fruit. Thus, as best shown in FIG. 7, inner container 1 essentially wraps about tunnel pad 53 in order to ensure that no portion of any of the bananas directly contacts tunnel pad 53. In this fashion, scarring of the bananas is avoided. Obviously, however this packing method requires that inner bag 1 be significantly larger than that which would normally be required if tunnel pad 53 could be positioned within bag 1.

Figure 12:
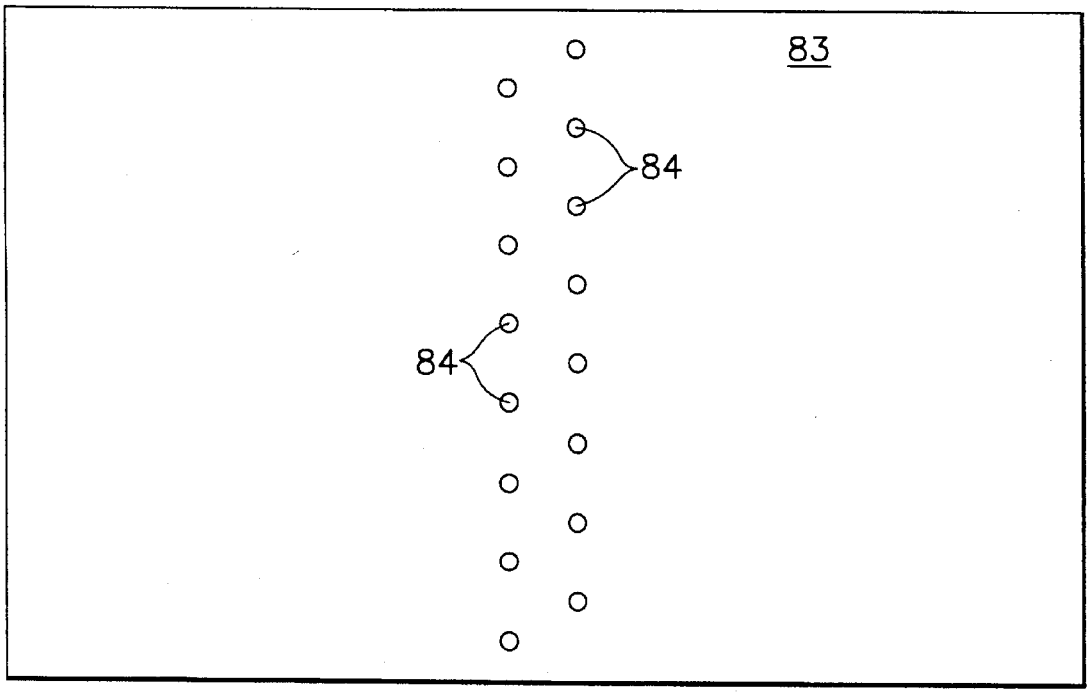
FIG. 12 is a top-planned view of the tunnel pad of the present invention.
Figure 13:
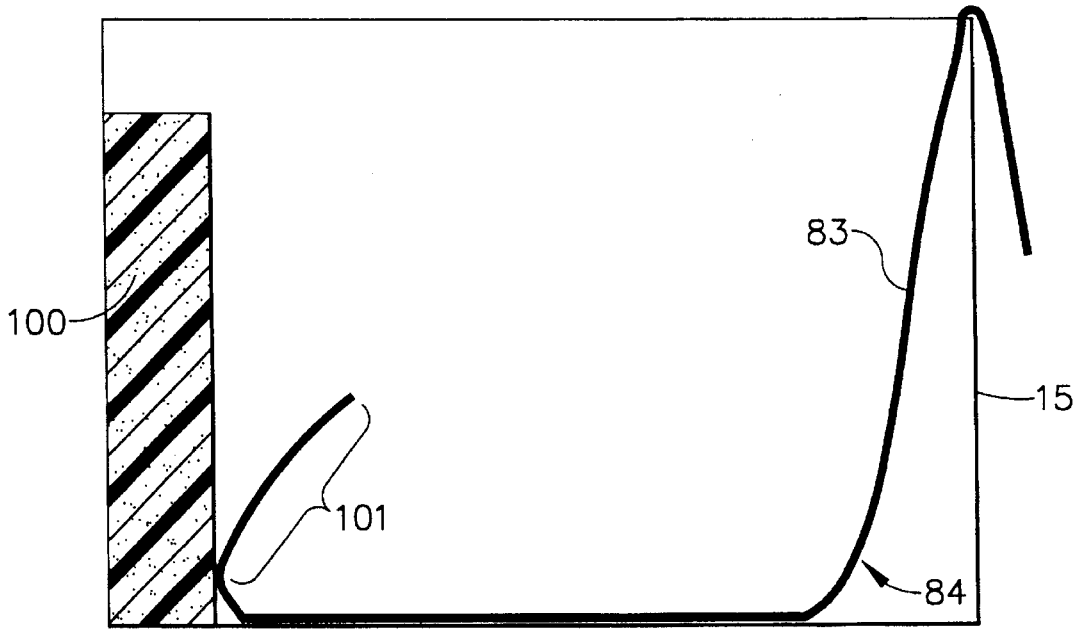
FIG. 13 is a cut-away view of the packing procedure of the present invention.

In order to overcome these deficiencies, the tunnel pad shown in FIG. 12 has been developed. Tunnel pad 83 may be effectively employed within bag 1 without noticeable scarring of the fruit. Tunnel pad 83 comprises a sheet of flexible plastic which is preferably between about 25 and about 35 inches in length (with a width as described above), most preferably about 31 inches. Tunnel pad 83 is preferably made from plastic, most preferably polyethylene. In fact, tunnel pad 83 may be manufactured from recycled polyethylene, since it is rather simple to produce sheets of recycled polyethylene. In order to produce a strong tunnel pad, however, it is preferred that the recycled material be sandwiched between two layers of virgin plastic. It is even possible that the polyethylene bags typically employed for covering banana bunches while the bunches are still growing on banana plants may be recycled for this use, particularly since there is a large supply of such used bags readily available.

Ventilation apertures 84 are preferably provided across the width of tunnel pad 83, more preferably in the form of two staggered rows of apertures aligned approximately on either side of the center-line of tunnel pad 83. As will be understood below, this permits proper alignment of the ventilation apertures no matter which end of tunnel pad 83 is first inserted into the corrugated box during the packing procedure.

Figure 15:
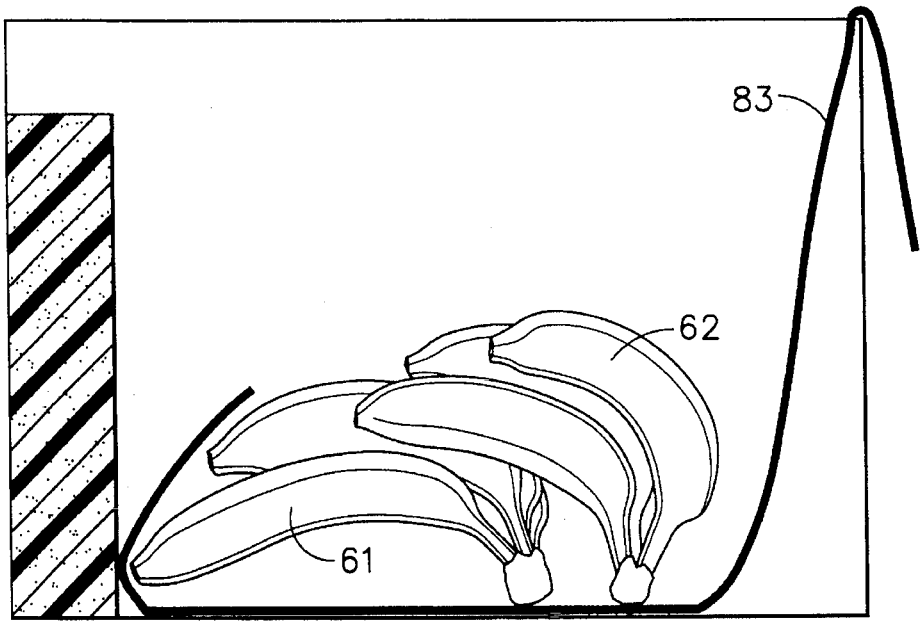
FIG. 15 is a cut-away view of the packing procedure of the present invention.

In order to prevent the crown portion of the uppermost rows of bananas from damaging clusters of bananas positioned beneath, tunnel pad 83 must be of sufficient thickness. Thus, it is preferred that tunnel pad 83 have a thickness of between about 5 and about 10 mils, most preferably about 7 mils. It should be pointed out that the crowns-up packing configuration for the third and fourth rows of bananas as described previously must also be employed. The prior art method or FIG. 6 will still result in damage caused by the crowns of rows 63 and 64 even when a plastic tunnel pad as thick as 12 mils is employed. Thus, the crowns-up packing method of FIG. 7 (which is prior art for the present application), or more preferably that of FIG. 15 should be employed.

Figure 17:
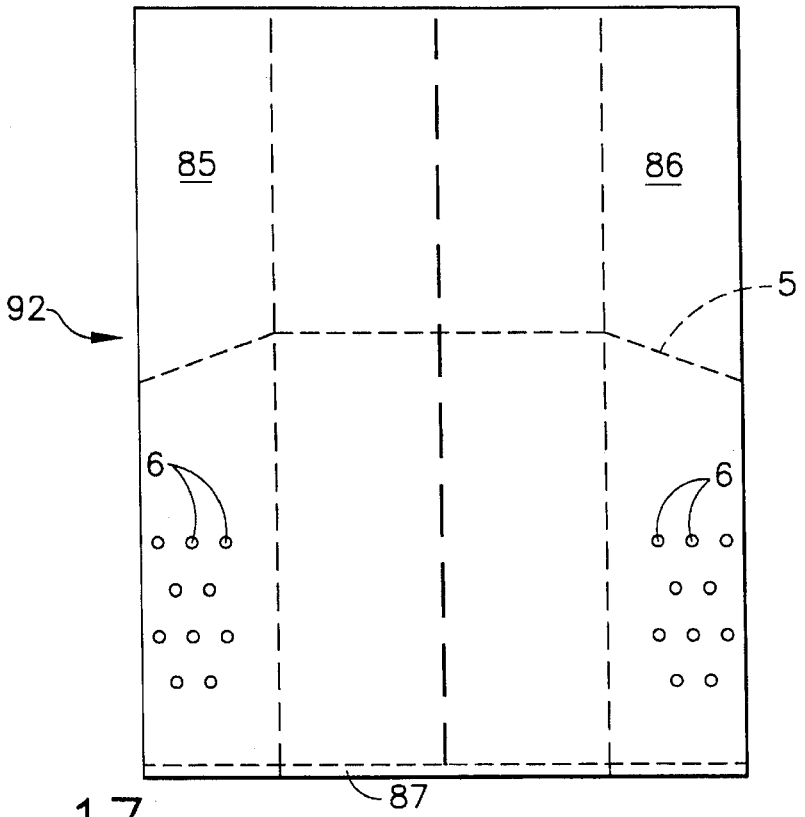
FIG. 17 is a side-plan view of an inner bag according to one embodiment of the present invention.
Figure 18:
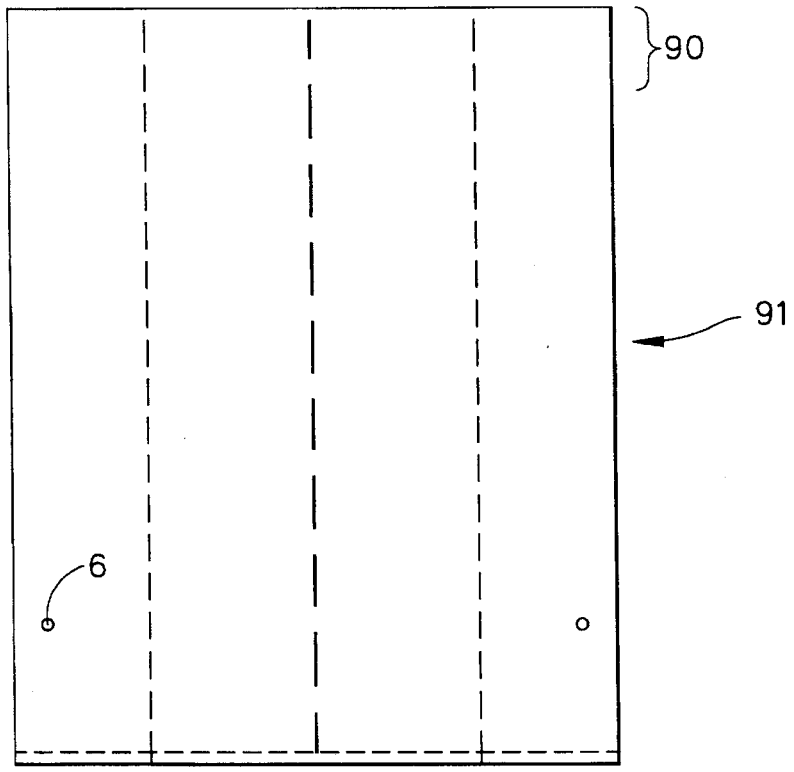
FIG. 18 is a side-plan view of another inner bag of the present invention.

As shown in FIG. 1, an inner container, or bag 91, may be employed with the new tunnel pad and packing pattern shown. Although bag 1 and cord 8 as previously described may be used, it is preferred that the modified bag designs of either FIG. 17 or FIG. 18 are employed. Bag 92 shown in FIG. 17 once again has a perforation 5 extending across its entire width, and therefore may be used with pull cord 8. The construction of bag 92, however is slightly modified from that shown in FIG. 1. First, bag 92 is gussetted in order to more fully fill the interior of the box. Thus, bag 92 has gussetted portions 85 and 86. The bottom of bag 92, however, is sealed across its entire width at 87, including gussetted portions 85 and 86.

As also shown in FIG. 17, perforation 5 preferably tapers downwardly on gussetted portions 85 and 86 in order to provide for a fuller opening of bag 92 when cord 8 is pulled. It will also be noted that once again ventilation apertures 6 are provided in the bag, and, since the bag is gussetted, the twenty ventilation apertures 6 which extend entirely through the bag will in fact result in 80 ventilation apertures. These ventilation apertures are positioned in the bottom corners of the bag, as was the case in the bag of FIG. 1, in order to properly align the ventilation apertures with the corners of the box so as to provide substantial vertical alignment with the ventilation apertures on outer container 15 (i.e.. the box).

Most significantly, bag 92 is considerably smaller in length than that shown in FIG. 1, due to the use of tunnel pad 83. Preferably, bag 92 has a length of between about 25 and about 36 inches, most preferably about 33 inches. Bag 1 shown in FIG. 1 (intended to be used with the packing method of FIG. 7) is approximately 50 inches long. Thus, the use of plastic tunnel pad 83 permits the use of a much shorter bag, thereby resulting in considerable savings and less disposables.

An additional advantage of tunnel pad 83 is that the tight packing pattern of FIG. 11 may be readily achieved (to be described). With this in mind, a non-perforated bag 91 shown in FIG. 18 may also be employed. Bag 91 is similar to those in the prior art, however, as was the case with the bag of FIG. 17, bag 91 is gussetted and sealed across its entire bottom. As also shown in FIG. 18, bag 91 may also have only eight apertures positioned in the manner shown (only two apertures are visible, however eight are actual present due to the gussetted design of bag 91). It should be kept in mind that the actual number of apertures may vary considerably depending on the shipping conditions encountered. For example, when the bananas are to have a longer transit time, fewer apertures are preferred in order to maintain the proper climate within the bag.

When bag 91 of FIG. 18 is employed, it will be understood that cord 8 need not be present (as shown in FIG. 11). Rather than tying cord 8 about the neck of the bag for closure purposes, a closure device 88 may be employed. Closure device 88 may be any device capable of sealing the top of bag 91. Thus, this closure may comprise a piece of wrapping tape secured about neck 90 of bag 91, or a similar device such as wire. Once again, bag 91 is considerably shorter than those employed in the prior art, since tunnel pad 83 permits the use of a much shorter bag than that employed in the prior art methods. Thus, bag 91 is preferably between about 25 and 36 inches in length, most preferably about 33 inches.

Figure 20:
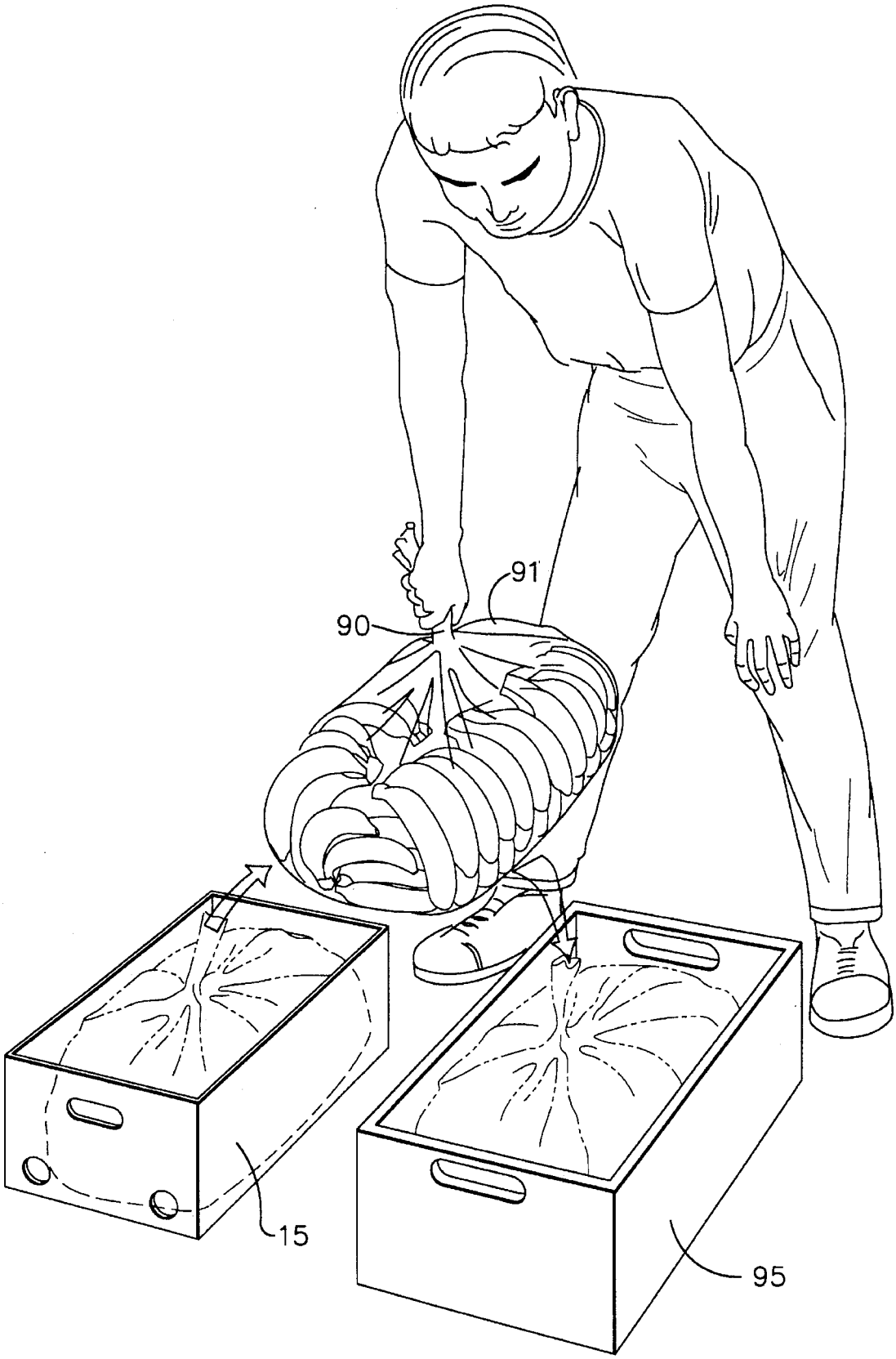
FIG. 20 is a perspective view of the "lift and shift" transfer procedure of the present invention.

More importantly, bag 91 should be made of a much thicker plastic material in order to permit one to lift the entire load of bananas from outer container 15 without a need to ever open bag 91 to accomplish this transfer. Thus, as shown in FIG. 20, neck portion 90 of bag 91 may be grasped in the manner shown to permit one to lift the entire load of bananas within bag 91 from outer container 15. This allows one to transfer the entire load to a second container 95 without a need to either individually unpack the banana clusters or even to open bag 91. In order to accomplish this, it is necessary that bag 91 be made of a thicker plastic, preferably polyethylene, in order to provide the necessary strength for the lifting and shifting operation. Preferably, therefore, the bag employed is manufactured from polyethylene having a thickness of between about 1.0 and about 2.0 mils, most preferably about 1.5 mils. The standard bag or tube employed in the prior art methods, on the other hand, has a thickness of only 0.5 mils, and thus is not suitable for this procedure.

The principle advantage of providing the "lift and shift" feature shown in FIG. 20, is that the entire load of bananas within bag 91 may be moved from outer container 15 (i.e., the box) to second container 95 merely by grasping neck portion 90 of bag 91. Because of the tight packing configuration of FIG. 11 (to be described later), the bananas will remain in their packed configuration during the transfer, thereby enabling an easy lift and shift process. As will be readily apparent, if the packing method of FIG. 7 is employed, bag 1, even if it were made of a sufficiently thick plastic to permit lifting without tearing, could not be lifted from the box without seriously disrupting the packing pattern of the bananas. Were one to attempt this procedure, the bananas could not be placed into container 95 in a fashion amenable to shipping or stacking of additional layers. Therefore, only by using tunnel pad 83 may the lift and shift procedure of FIG. 20 be employed.

As will also be apparent, container 95 should be at least as large, and preferably slightly greater in dimension, than container 15 in order to facilitate shifting of the bananas without causing damage. Preferably, container 95 comprises a light-weight, reusable container such as that typically employed in Europe for the transfer of fruits and vegetables to retailers. One particularly advantageous type of container which can be employed in the process of the present invention is that manufactured by Schoeller International GmgH, of Munich, Germany (distributed through its IFCO subsidiary in Dusseldorf), and described in U.S. Pat. No. 5,398,834. These containers are made from plastic, and may be folded down flat for return transit. Such containers are readily reusable, and may even be employed for various types of fruits and vegetables. These containers are also stackable with one another, and readily fit upon standard pallets.

When the packaged bananas arrive at either a port or distribution warehouse, a worker may perform the lift and shift procedure of FIG. 20. Bag 91 of bananas may be transferred in its entirety from corrugated box 15 to reusable plastic container 95. Plastic container 95 containing the bagged bananas is then transported either to another warehouse or more preferably to the retailer. The retailer is then saved the aggravation of having to dispose of corrugated container 15. Once the bananas arrive at the retailer, the retailer may remove the bananas for display and sale, and then return container 95 to the warehouse or port in order to obtain more bananas or even other types of fruits. Thus, the packaging methods of the present invention provide the first means by which bananas may be shipped to a retailer in reusable, standardized containers 95. Such containers are gaining widespread acceptance in the retail marketplace (particularly in Europe), and the present invention adds even greater flexibility to these containers. Cardboard container 15 may be reused or disposed of, as needed, by the producer/shipper.

The lift and shift procedure of the present invention is also advantageous in that the procedure may be entirely automated. Thus, robotic arms or the like may be used to grasp neck 90 of bag 91 in order to transfer bag 91 and its contents to container 95 or the like. Since bananas are normally positioned on pallets in an orderly fashion for shipment purposes, automating the lift and shift procedure is rather straight-forward for one skilled in the art to implement. In this manner, the entire lift and shift procedure may be performed by non-human means.

Figure 19:
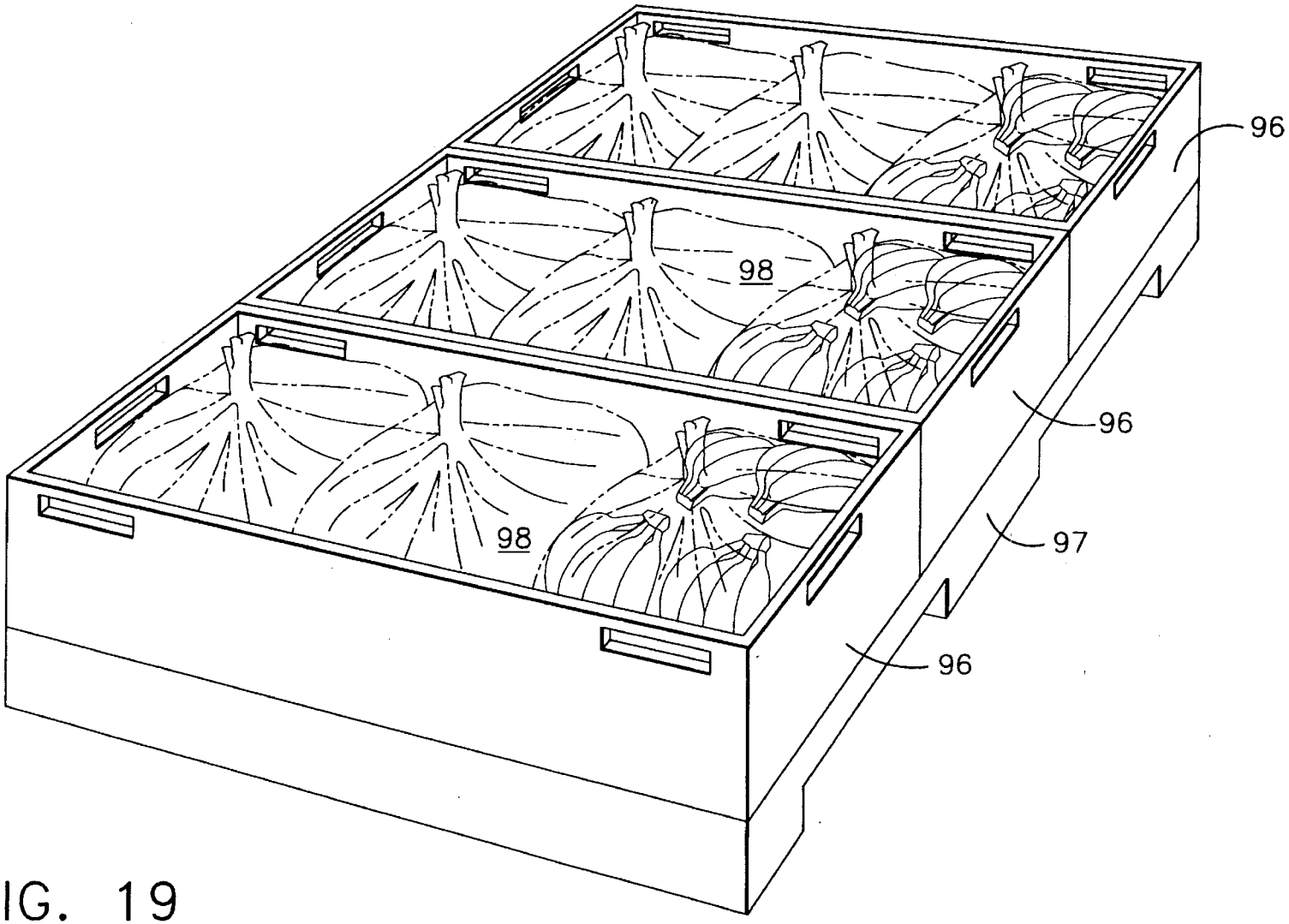
FIG. 19 is a perspective view of a packing/shipping method of the present invention.

FIG. 19 depicts yet another aspect of the present invention wherein a scaled down version of the bag of packed bananas is employed. In the embodiment of FIG. 24, reusable containers 96 are provided. Each of containers 96 preferably has a length approximately equivalent to the width of a pallet 97, and a width approximately equivalent to one third of the length of pallet 97. As will be understood, various other configurations for reusable containers 96 may also be employed, and these dimensions are not critical. The key aspect of the embodiment shown in FIG. 24, however, is that the bananas are once again packaged into plastic bags 98 in the same fashion as shown in FIG. 11. Bag 98 is identical in construction to that shown in FIG. 18, however it is slightly narrower in width. Thus, whereas the standard box typically employed in shipping bananas may have four or five clusters comprising each row as packaged, bag 98 is only sufficiently wide to permit at most three clusters of bananas in each row. Although the packaging pattern is the same as shown in FIG. 11, fewer bananas will be contained in bag 98 since only at most three clusters will be present within each of the four rows of bananas. Thus, each bag 98 will only hold approximately 25 pounds of bananas, as opposed to the approximately 40–42 pounds present in bag 91 of FIG. 20.

In order to package the bananas as shown in FIG. 19, a rectangular jig may be provided. This rectangular jig is identical in appearance to container 15, however its length is slightly less than that of container 15. Bananas are packaged in this jig in the same manner as shown in FIG. 11, however, as mentioned above, at most only three clusters of bananas are placed in each row. Once the bananas have been packaged in bag 98 within the jig and the neck of bag 98 has been sealed by means of closure tape 88 or the like, the lift and shift procedure (either manually or by automated means) of FIG. 20 may be employed to transfer bag 98 full of bananas to container 96. This may be repeated for the two additional bags of bananas within each container 96, and two additional reusable containers 96 full of bananas. Containers 96 are preferably stackable with one another so that additional layers may be stacked atop those shown, and are also preferably made from a reusable material such as plastic or the like. Ventilation openings and lids may be provided as needed, and containers 96 may be manufactured so as to fold down flat for return. In this manner, the bananas may be shipped to a port of entry in the manner shown in FIG. 19, and then individual bags 98 of bananas may be removed from containers 96 (by the "lift and shift" method) and placed into smaller shipping containers for transit to either a warehouse or a retailer. Retailers may then be provided with a smaller package of bananas as needed, and the container into which bags 98 are transferred from containers 96 may even be small, reusable containers such as that described in conjunction with FIG. 20.

As mentioned previously, in order to facilitate the use of tunnel pad 83, the packing configuration of FIG. 11 is also preferably employed. As shown in FIG. 11, the crowns-up packaging method is once again employed, however the orientation of first row 61 is reversed. It is imperative that the crowns-up configuration be employed when tunnel pad 83 is used since a crowns-down configuration will still cause damage to the underlying fruit no matter how thick plastic tunnel pad 83 is.

FIGS. 11, and 13–16 depict the steps of packaging the bananas in the manner shown in FIG. 11. Thus, in FIG. 13, a spacer 100 is first inserted into container or box 15. This spacer has a length approximately equivalent to or slightly less than the length of container 15, and a thickness of approximately 1.5 inches. Spacer 100 ensures the proper alignment of bananas. Bag 1 or 23, whichever is employed, is not shown in FIGS. 13–16 for purposes of clarity. The bag is, however, inserted either before or after spacer 20, and is opened so that the entire interior of the bag present within container 15 may be accessed. If container 15 has a ventilation opening positioned in its bottom panel, a single sheet of Kraft paper or other suitable material may be placed atop the opening in order to prevent bananas from falling through. This sheet of protective Kraft paper must be inserted prior to insertion of bag 1 or 23, however, since it is not desirable for this protective sheet to contact the bananas.

After insertion of spacer 100 and bag 1, tunnel pad 83 is next inserted into container 15 in the manner shown. Tunnel pad 83 is positioned so that a portion drapes over the sidewall of box 15, and also so that portion 101 of tunnel pad 83 extends upwardly from the bottom of container 15. This placement ensures that ventilation openings 84 will be positioned in the location shown in FIG. 13, wherein ventilation openings 84 will not contact the bottom of container 15.

Figure 14:
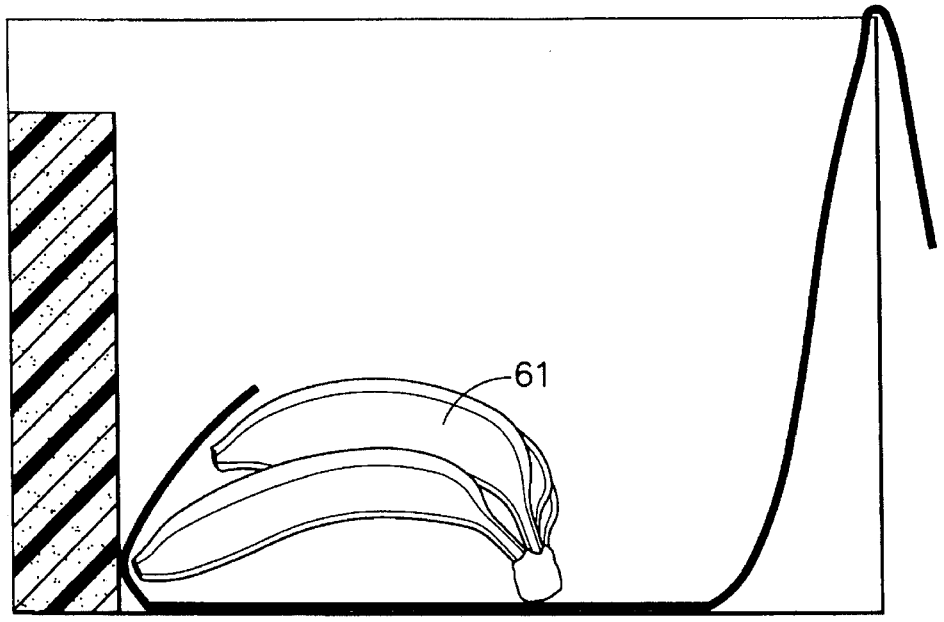
FIG. 14 is a cut-away view of the packing procedure of the present invention.

As shown in FIG. 14, first row 61 of banana clusters is positioned in the bottom of container 15 atop tunnel pad 83. The tip portion of first row 61 should abut spacer 100, thereby positioning the crown portion near the center-line of container 15. It is also preferable that first row 61 comprise medium-size bananas. As next shown in FIG. 15, second row 62 is then placed atop first row 61 in a nesting arrangement with the crown portion of the bananas of row 16 adjacent the crown portion of the bananas of row 61 in the manner shown. In order to facilitate nesting, the bananas of row 62 should be slightly smaller than those of row 61. Thus, it is preferred that all of the bananas be sized in relation to one another prior to the packing steps (as is currently done in the prior art packing methods).

Figure 16:
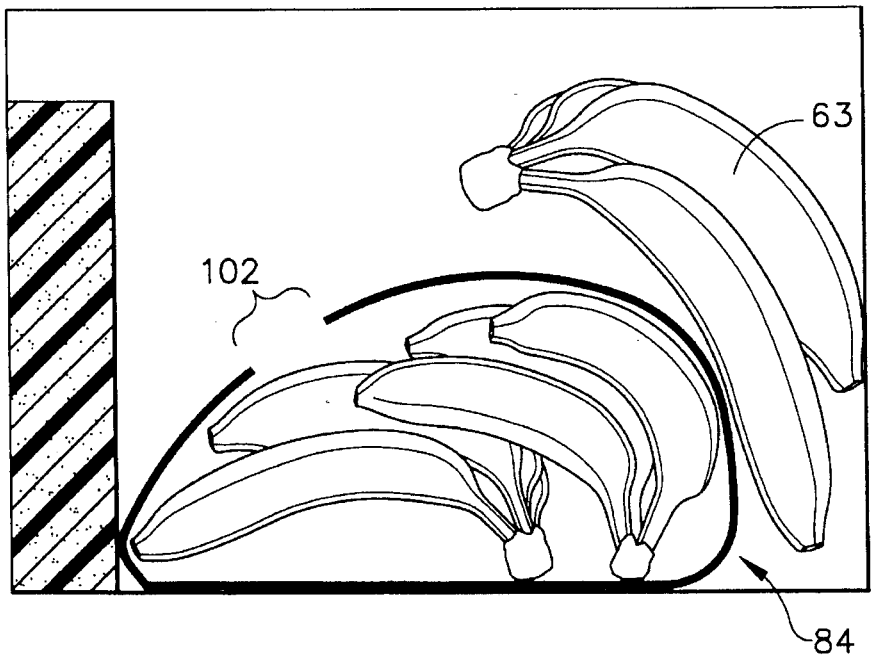
FIG. 16 is a cut-away view of the packing procedure of the present invention.

After second row 62 has been positioned in place, tunnel pad 83 is then folded over second row 62 in the manner shown in FIG. 16. Because of the length of tunnel pad 83, a small gap 102 will be present, thereby providing further ventilation to rows 61 and 62 when the packaging has been completed. As will also be noted, ventilation openings 84 in tunnel pad 83 will be positioned so as to provide ventilating communication between rows of bananas. In other words, ventilation openings 84 will not be blocked by either the bottom of container 15 or rows of bananas. One advantage to using the tunnel pad configuration of FIG. 12 is that, since ventilation openings 84 are aligned along a center line of tunnel pad 83, ventilation openings 84 will also be aligned in the manner shown in FIG. 16 whenever tunnel pad 83 is inserted into container 15 in the manner shown in FIG. 13. In other words, no matter which end of tunnel pad 83 comprises free end 101 of FIG. 13, ventilation openings 84 will be aligned as shown.

Finally, as shown in FIG. 16, third row 63 of banana clusters is then placed atop second row 62 in the manner shown with the tip portion of row 63 wedged between second row 62 and the sidewall container 15. Spacer 100 is then removed, and fourth row 64 is then placed into container 15 in a similar fashion on the opposite side (see FIG. 11). Third and fourth rows 63 and 64 should comprise the longest bananas, with those of row 64 preferably being longer than those of row 63. This packing pattern provides a convenient tight arrangement amenable to the lift and shift procedure, while still providing adequate ventilation between banana layers.

The foregoing description of a preferred embodiment is by no means exhaustive of the variations in the present invention that are possible, and has been presented only for purposes of illustration and description. Obvious modifications and variations will be apparent to those skilled in the art in light of the teachings of the foregoing description. Thus, it is intended that the scope of the present invention be defined by the claims appended hereto.

What we claim is:

1. A method of producing a container of banana clusters, comprising the steps of:

(a) providing a plurality of banana clusters, each of said clusters comprising a plurality of bananas, each of said banana clusters having a tip portion and a crown, said bananas of each cluster connected to one another at said crown;

(b) providing an outer container for said bananas, said outer container being of a rectangular construction having first and second parallel sidewalls, first and second parallel endwalls, and an interior bottom;

(c) inserting a flexible inner container within said outer container prior to placing said banana clusters in said outer container, so that said rows of banana clusters are placed within said inner container and will thereby not contact the interior surfaces of said outer container;

(d) providing a tunnel pad having a width at least as great as the length of said sidewalls and a length greater than the length of said endwalls;

(e) placing a first row of banana clusters in said inner container atop said interior bottom;

(f) placing a second row of banana clusters in said inner container such that a portion of each banana cluster of said second row is positioned atop a portion of the bananas of said first row;

(g) positioning a portion of said tunnel pad atop and in direct contact with at least a portion of the bananas of said first and second rows;

(h) placing a third row of banana clusters in said inner container atop a portion of said tunnel pad; and (j) placing a fourth row of banana clusters in said inner container atop at a portion of said tunnel pad.

2. The method of claim 1, wherein said tunnel pad comprising a sheet of flexible plastic material.

3. The method of claim 2, further comprising the step of placing said tunnel pad within said inner container prior to placing said banana clusters in said inner container such that said tunnel pad extends across the interior bottom of said outer container, wherein a portion of said first row of bananas is positioned atop said tunnel pad, and wherein said step of positioning a portion of said tunnel pad atop at least a portion of the bananas of said first and second rows is accomplished by folding said tunnel pad over said first and second rows of banana clusters prior to placing said third and fourth rows of banana clusters in said outer container, thereby positioning a portion of said tunnel pad between said third and fourth rows and said first and second rows.

4. The method of claim 3, wherein said tunnel pad has a plurality of ventilation apertures extending therethrough.

5. The method of claim 4, wherein said ventilation apertures extend across the width of said tunnel pad and are positioned adjacent a centerline extending across the width of said tunnel pad.

6. The method of claim 4, wherein said ventilation apertures are positioned such that at least a portion of said apertures are not blocked by either the interior bottom of said outer container or any of said bananas, thereby providing ventilating communication between the bananas of said first or second rows with the bananas of said third or fourth rows.

7. The method of claim 3, wherein said tunnel pad extends at least partially up the sidewalls of said outer container prior to the placement of said bananas, and wherein the length of the tunnel pad is such that said step of folding the tunnel pad over said first and second rows of bananas will not cause opposing ends of said tunnel pad to overlap.

8. The method of claim 1, wherein said inner container comprises a plastic bag having a neck portion and an opening adjacent said neck portion, and further comprising the step of sealing said bag at said neck.

9. The method of claim 8, wherein said inner container is manufactured from a plastic having sufficient strength so as to permit one to grasp said sealed neck and lift said bag containing all of said bananas thereby removing said bag and said bananas from said outer container for transfer.

10. The method of claim 9, wherein said bag is made from polyethylene having a thickness of between about 1.0 and about 2.0 mils.

11. A method of transferring a load of bananas from a first outer container to a second outer container, comprising the steps of:

(a) providing a first outer container having and an inner bag containing a plurality of banana clusters therein:

said first outer container being of a rectangular construction having first and second parallel sidewalls, first and second parallel endwalls, and an interior bottom;

each of said banana clusters comprising a plurality of bananas, each of said banana clusters having a tip portion and a crown, said bananas of each cluster connected to one another at said crown;

said bananas positioned in said bag in four rows of clusters such that said bananas do not contact the interior bottom of said first outer container;

the first row of banana clusters positioned atop said interior bottom of said first outer container;

the second row of banana clusters positioned such that a portion of each banana cluster of said second row is atop a portion of the bananas of said first row;

a tunnel pad positioned atop at least a portion of the bananas of said first and second rows the third row of banana clusters positioned atop a portion of said tunnel pad;

the fourth row of banana clusters positioned atop a portion of said tunnel pad;

said bag having a neck portion and an opening adjacent said neck portion, and said bag sealed at said neck;

(b) providing a second outer container having a length and width at least as great as that of said first outer container;

(c) grasping said neck of said bag;

(d) lifting said bag containing said bananas out of said first container;

(e) placing said bag containing said bananas within said second outer container, thereby transferring said bananas from the first container to the second container without removing said bananas from said bag.

12. The method of claim 11, wherein said first outer container is a corrugated box, and wherein said second outer container is reuseable and made from plastic.

13. The method of claim 11, wherein said first outer container comprises a reusable jig.

14. The method of claim 13, wherein said second outer container comprises a reusable sipping container sized so as to permit a plurality of said bags containing said bananas to be placed therein, further comprising repeating steps (a) through (e), thereby resulting in a second bag containing a plurality of banana clusters positioned in said second container adjacent the first bag containing a plurality of banana clusters.

15. The method of claim 11, wherein said tunnel pad comprises a sheet of plastic having a width at least as great as the length of said sidewalls of said first outer container and a length greater than the length of said endwalls of said first outer container, wherein said tunnel pad is positioned between said first row of bananas and the interior bottom of said first outer container, and wherein said tunnel is wrapped over top of said first and second rows of bananas thereby positioning said tunnel pad between at least a portion of the bananas of said first and second rows, and the bananas of said third and fourth rows.

16. The method of claim 11, wherein steps (c) through (e) are performed manually.

17. The method of claim 11, wherein steps (c) through (e) are performed by a robotic arm.

* * * * *